US008220422B2

(12) United States Patent
Pattakos et al.

(10) Patent No.: US 8,220,422 B2
(45) Date of Patent: Jul. 17, 2012

(54) RACK GEAR VARIABLE COMPRESSION RATIO ENGINES

(76) Inventors: Manousos Pattakos, Nikea Piraeus (GR); Vithleem Sanniou-Pattakou, Athens (GR); Emmanouel Pattakos, Nikea Piraeus (GR)

( * ) Notice: Subject to any disclaimer, the term of this patent is extended or adjusted under 35 U.S.C. 154(b) by 519 days.

(21) Appl. No.: 12/546,714

(22) Filed: Aug. 25, 2009

(65) Prior Publication Data

US 2011/0048382 A1 Mar. 3, 2011

(51) Int. Cl.
*F02B 75/04* (2006.01)
*F02D 15/02* (2006.01)

(52) U.S. Cl. ..... 123/48 B; 123/48 C; 123/78 BA; 123/78 E; 123/78 F

(58) Field of Classification Search ..... 123/48 B, 123/48 C, 78 BA, 78 E, 78 F
See application file for complete search history.

(56) References Cited

U.S. PATENT DOCUMENTS

| | | | | | |
|---|---|---|---|---|---|
| 1,636,612 | A * | 7/1927 | Noah | 74/32 |
| 3,861,222 | A * | 1/1975 | Braun et al. | 74/44 |
| 4,085,711 | A * | 4/1978 | Braun | 123/46 B |
| 5,056,475 | A * | 10/1991 | Park | 123/54.1 |
| 5,528,946 | A * | 6/1996 | Yadegar | 74/31 |
| 5,682,853 | A * | 11/1997 | Hull et al. | 123/197.3 |
| 6,354,252 | B1 * | 3/2002 | Rabhi | 123/78 BA |
| 7,441,530 | B2 * | 10/2008 | Tinker | 123/197.4 |
| 7,562,642 | B2 * | 7/2009 | Rabhi | 123/48 B |
| 7,909,012 | B2 * | 3/2011 | Pattakos et al. | 123/197.4 |
| 2006/0243227 | A1 * | 11/2006 | Greve | 123/48 B |

* cited by examiner

*Primary Examiner* — Noah Kamen
*Assistant Examiner* — Grant Moubry

(57) ABSTRACT

The double-sided arrangement of a rack gear variable compression ratio engine improves the packaging, increases the rev limit, reduces the friction and the forces on the thrust rollers.

8 Claims, 24 Drawing Sheets

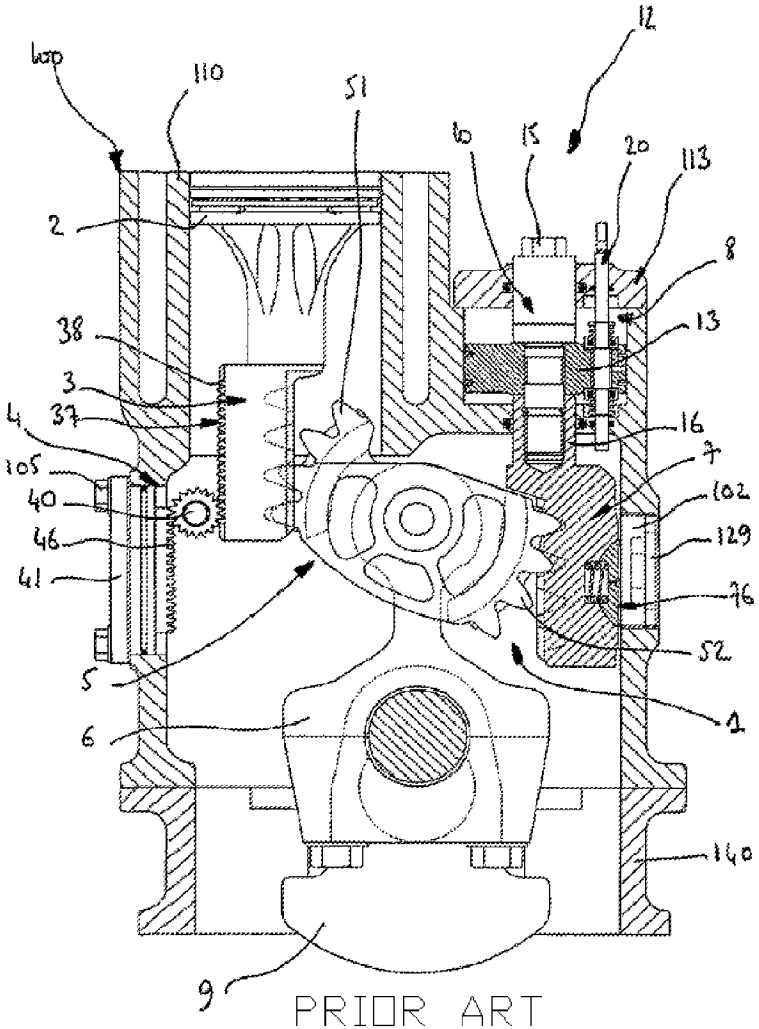
PRIOR ART
Fig 19
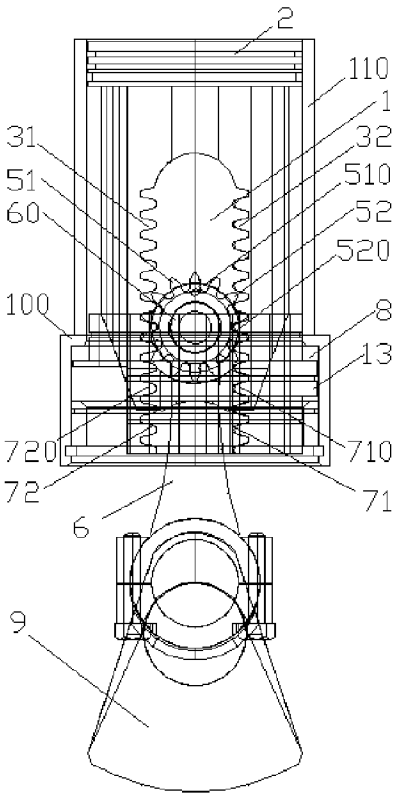
same stroke

RACK GEAR VARIABLE COMPRESSION RATIO ENGINES

In U.S. Pat. No. 7,562,642 and U.S. Pat. No. 6,354,252, which are the closest prior art, a crankshaft, through a connecting rod and a wrist pin, displaces a big gear wheel. The big gear wheel is meshed at one side with a control rack and at the other side with a one-sided rack secured on a piston. The piston is movable within a cylinder. A synchronized, by small gear wheels and small racks, roller supports the backside of the piston rack and takes the thrust loads. The compression ratio changes continuously by the displacement of the control rack. In comparison to the one-sided mechanism of the closest prior art, the symmetrical mechanism of the present invention is advantageous. For instance, for the same capacity the proposed engine is substantially downsized. The synchronized rollers are released form most of the closest prior art loads. The piston is lighter, yet more robust. The piston mass is symmetrically distributed around the cylinder axis, reducing the bending loads and the inertia torques. The crankshaft axis remains as close to the cylinder axis as desirable. The surfaces where the rollers abut on are integrated, together with the control racks, in a compact and robust frame, releasing the engine casing from vibrations and adjusters. The piston rack is functional at both sides and the forces are distributed on more teeth and surfaces.

In U.S. Pat. No. 3,861,222, the second closest prior art, the inertia force generated by the reciprocating piston is perfectly balanced by a secondary piston that reciprocates in opposite direction, with drawbacks the engine height increase, the inertia loads increase and of the friction increase. The present invention substantially reduces the total height and the friction, and improves the high revving capability of the engine.

Figure 1:
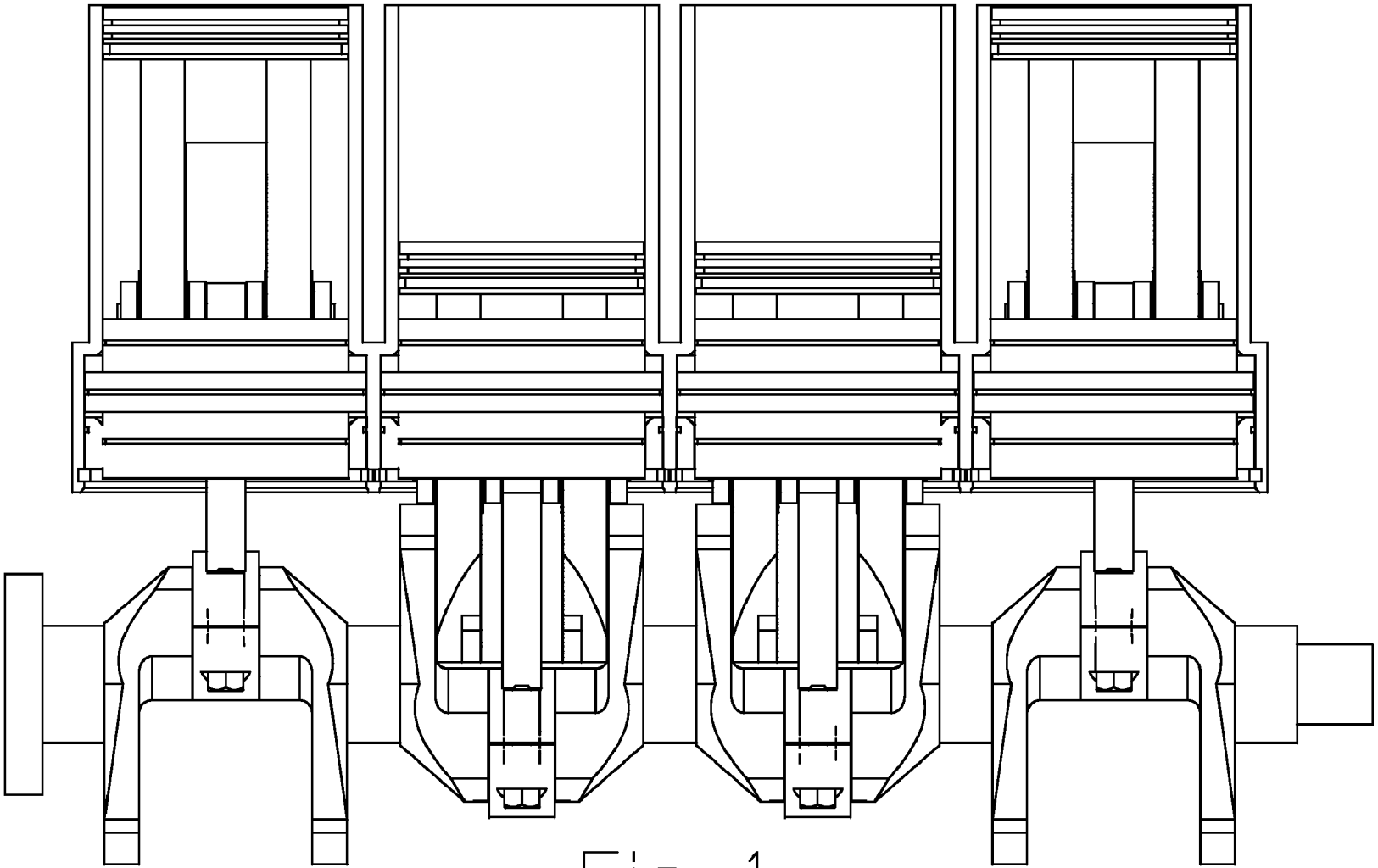
FIG. 1 shows a view of a four in-line engine according the first preferred embodiment.
Figure 2:
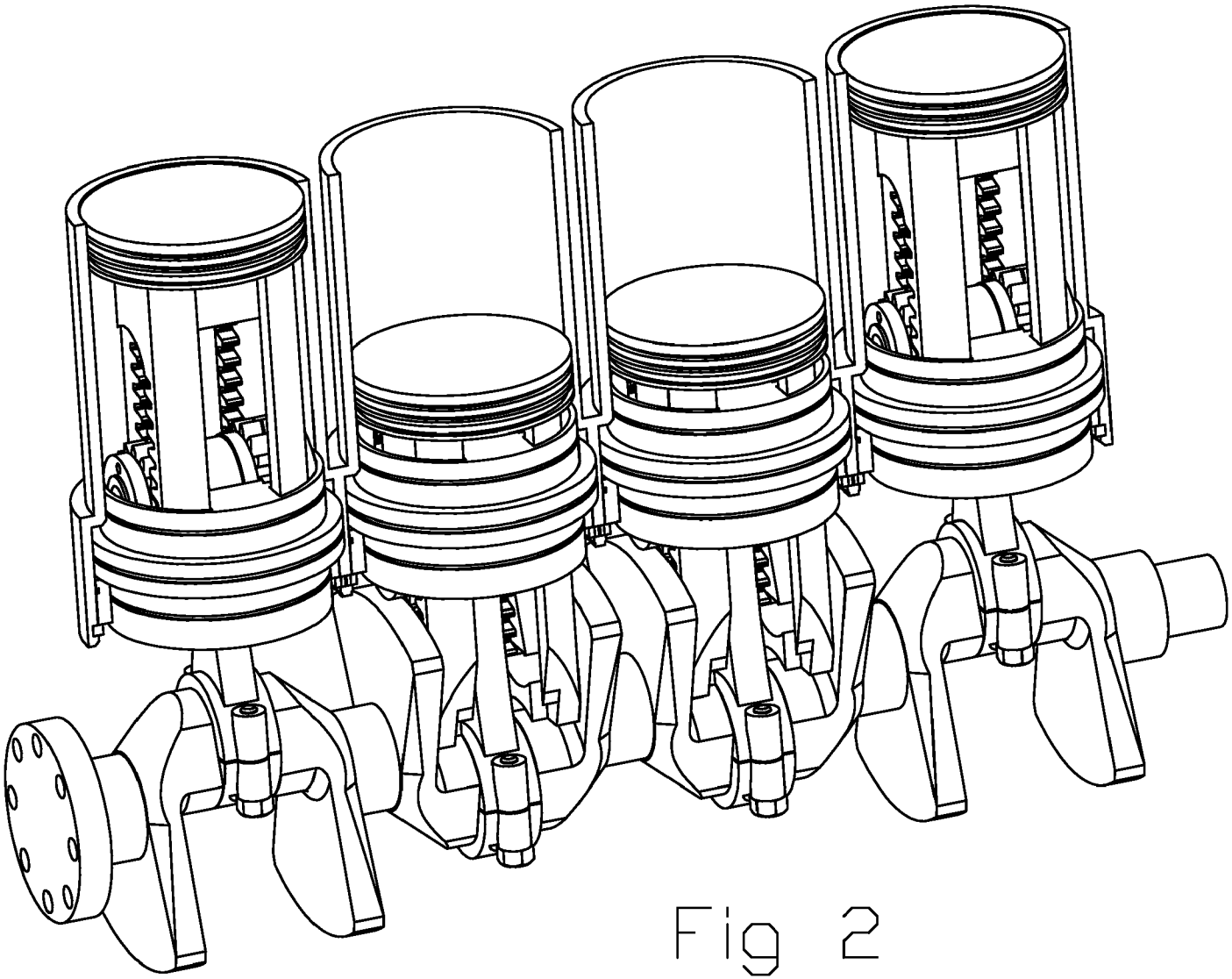
FIG. 2 shows another view of the engine of FIG. 1.
Figure 3:
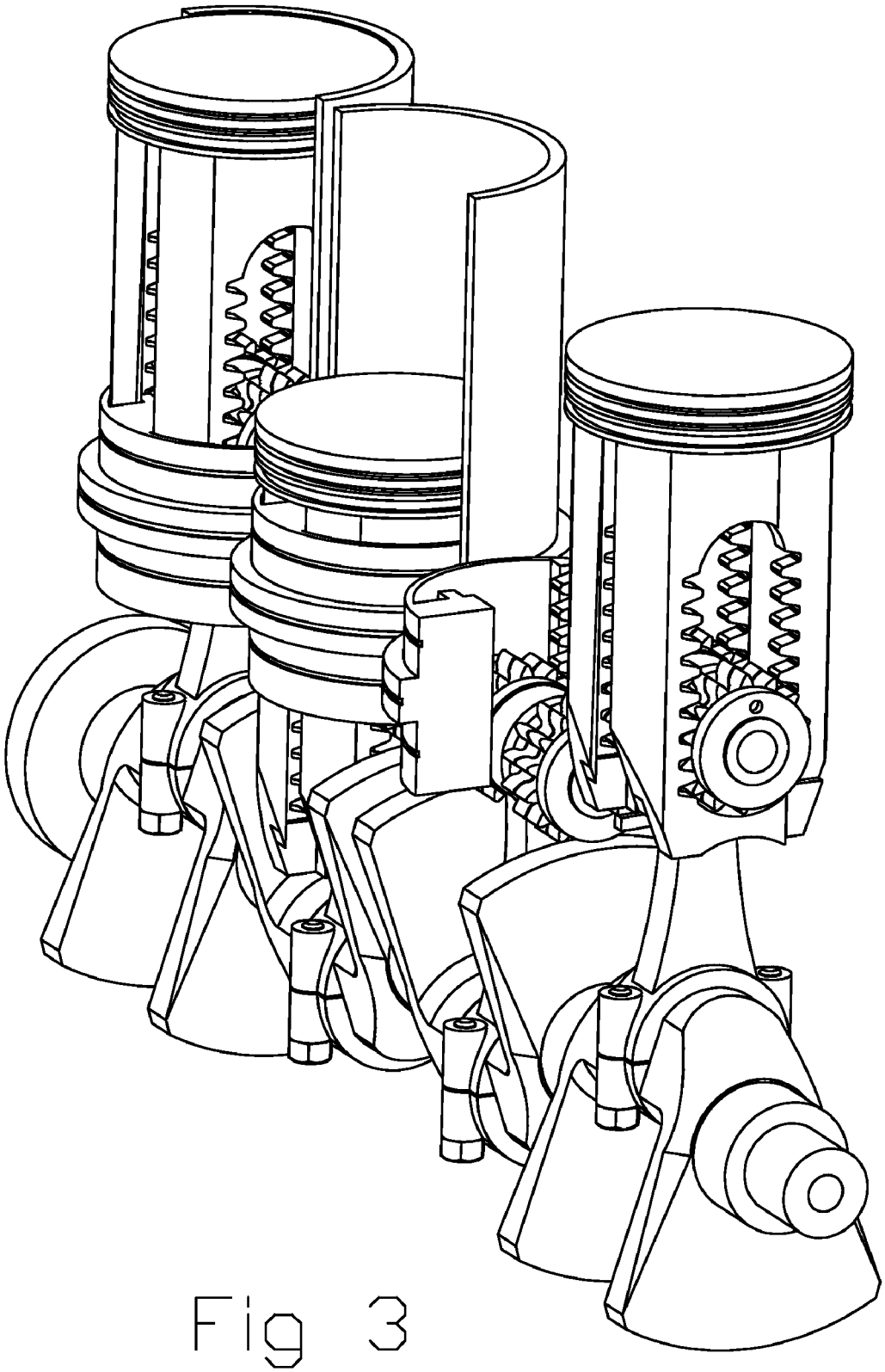
FIG. 3 shows another view of the engine of FIG. 1 with some parts removed.
Figure 4:
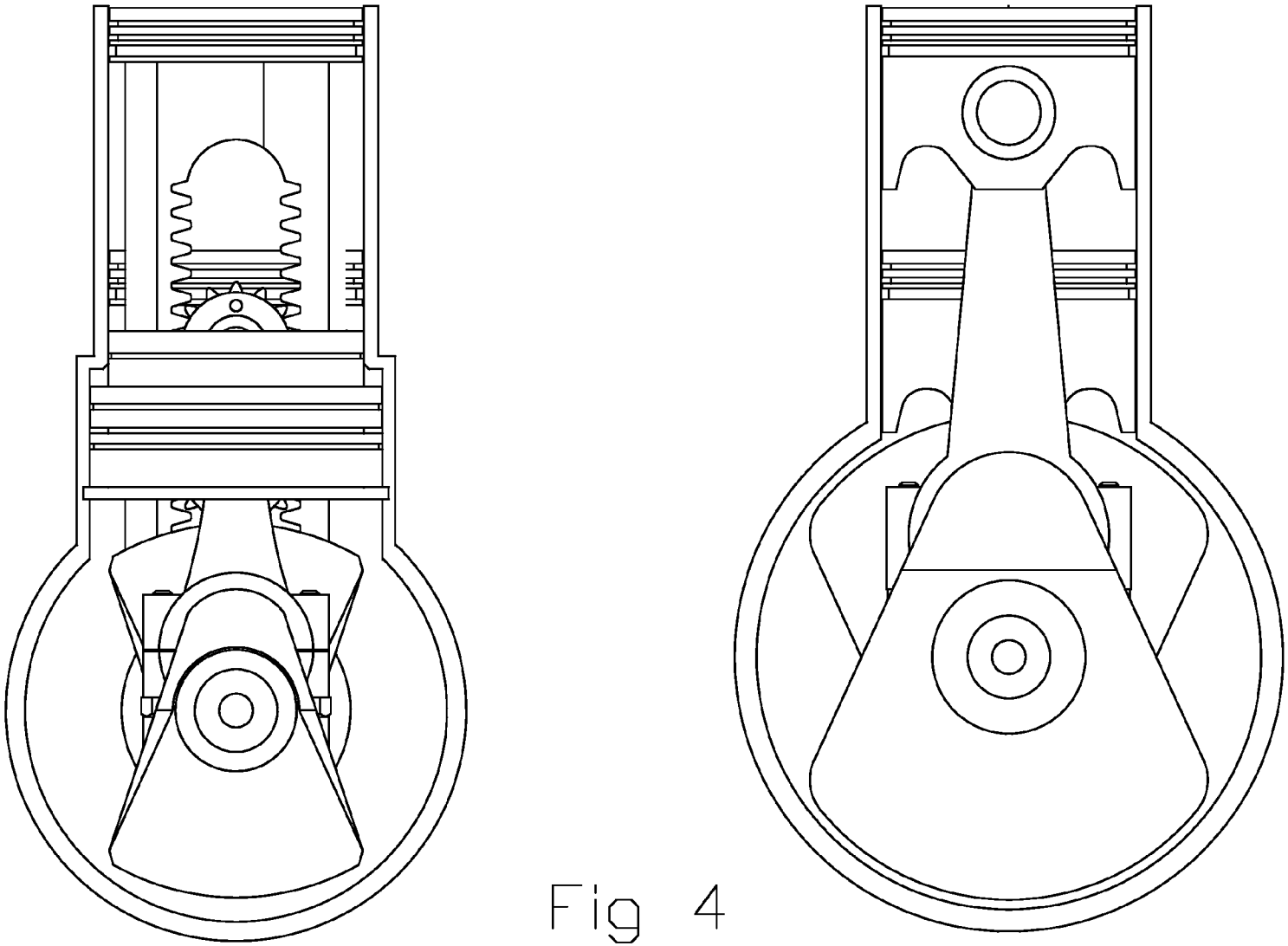
FIG. 4 shows the proposed arrangement versus the conventional engine of same piston stroke.
Figure 6:
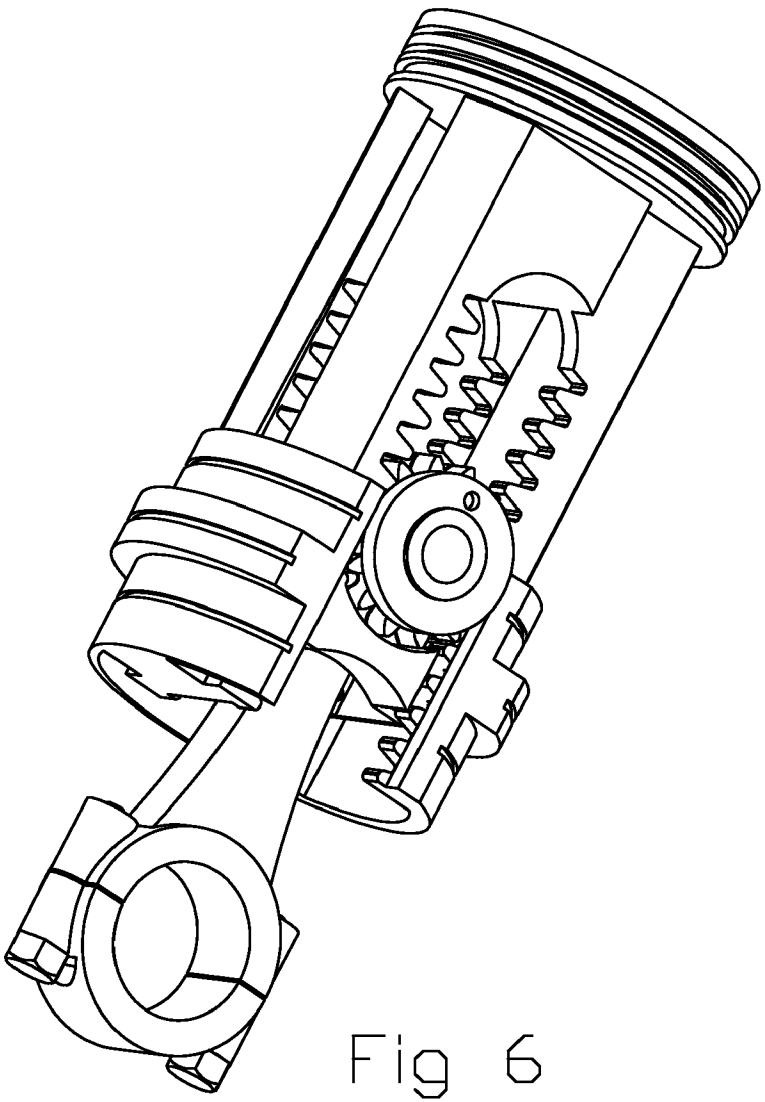
FIG. 6 shows what FIG. 5 with some parts sliced to show the inner parts.
Figure 5:
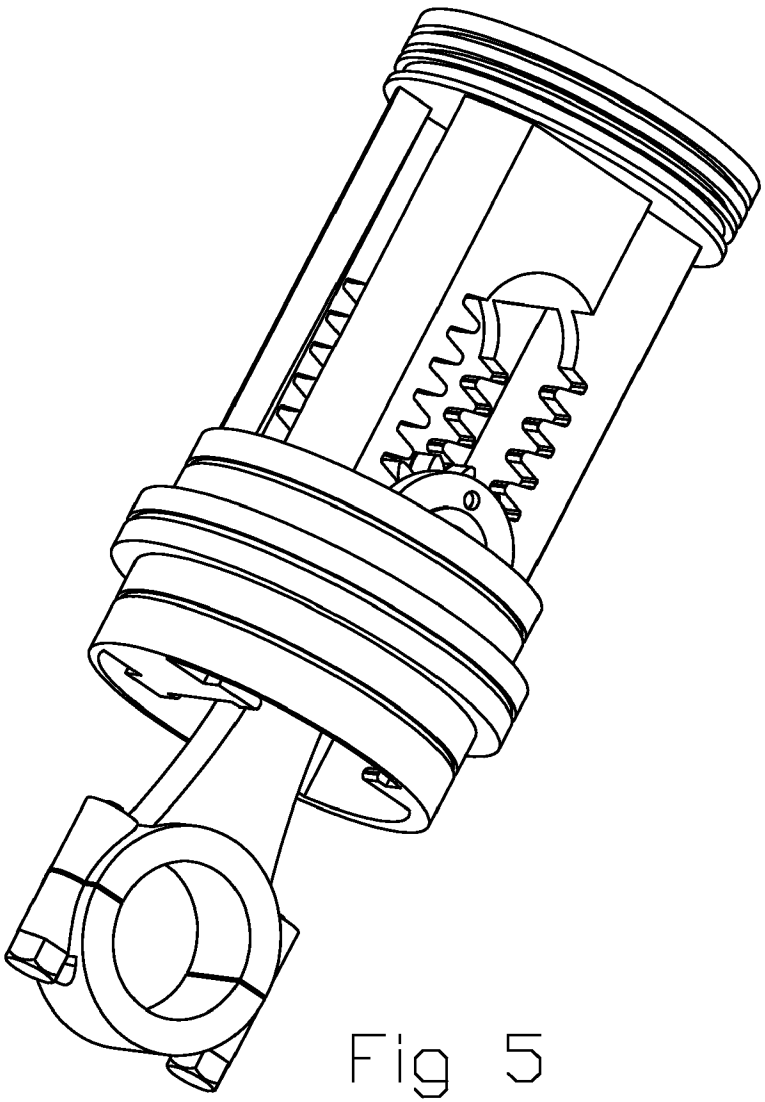
FIG. 5 shows the moving parts of the first preferred embodiment.
Figure 8:
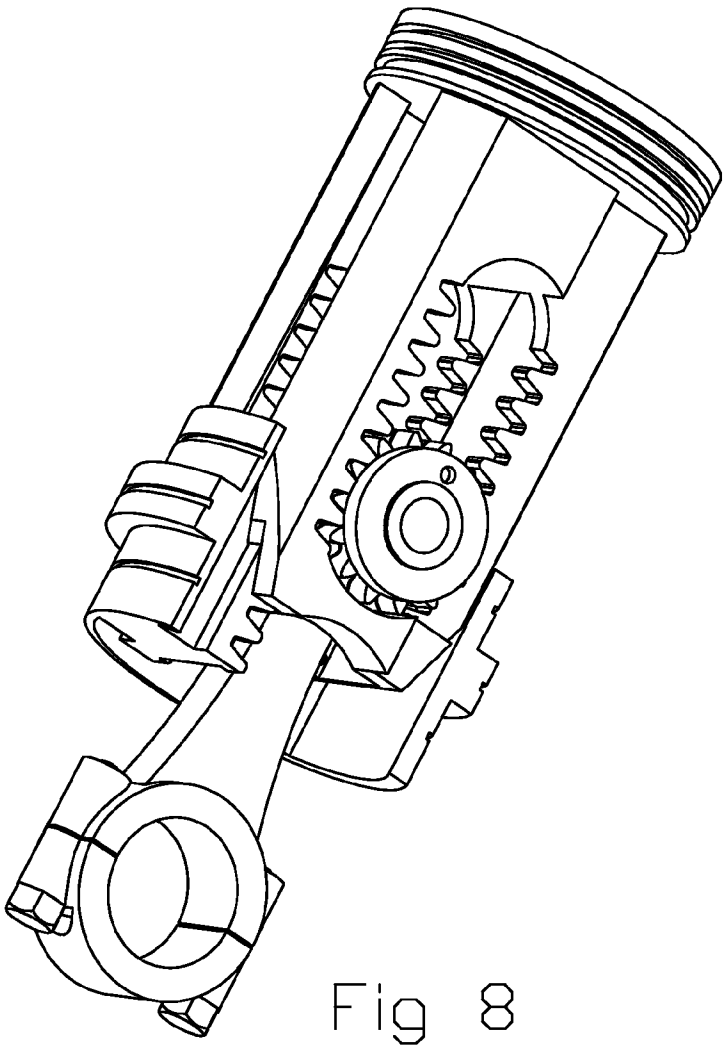
FIG. 8 shows what FIG. 5 with some parts sliced to show the inner parts.
Figure 7:
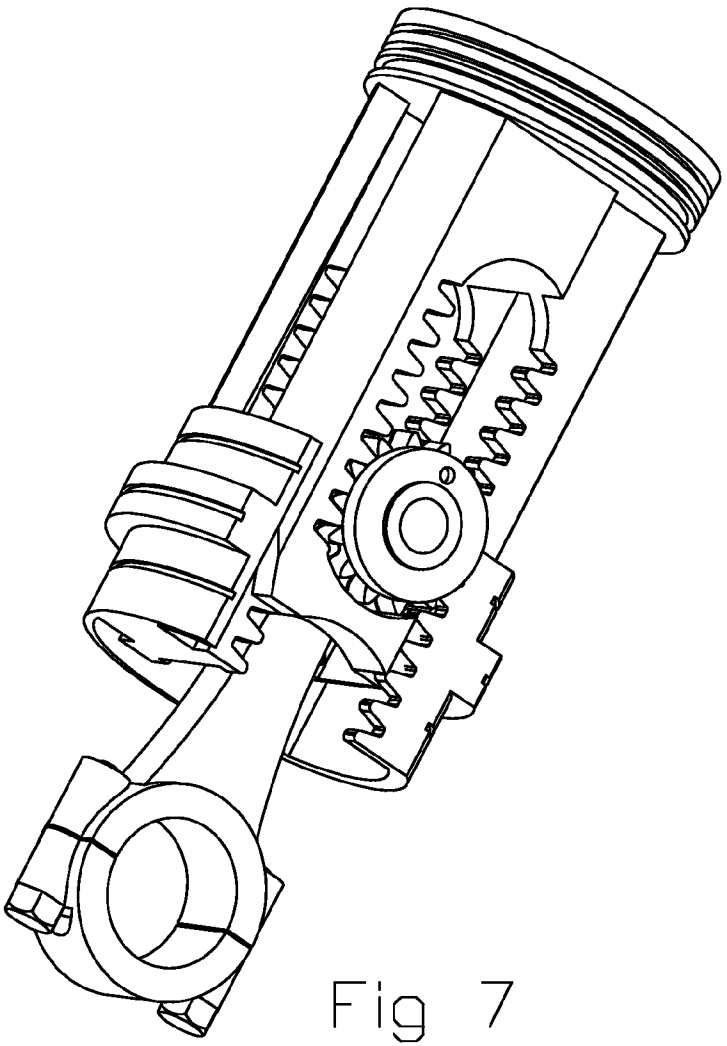
FIG. 7 shows what FIG. 5 with some parts sliced to show the inner parts.
Figure 9:
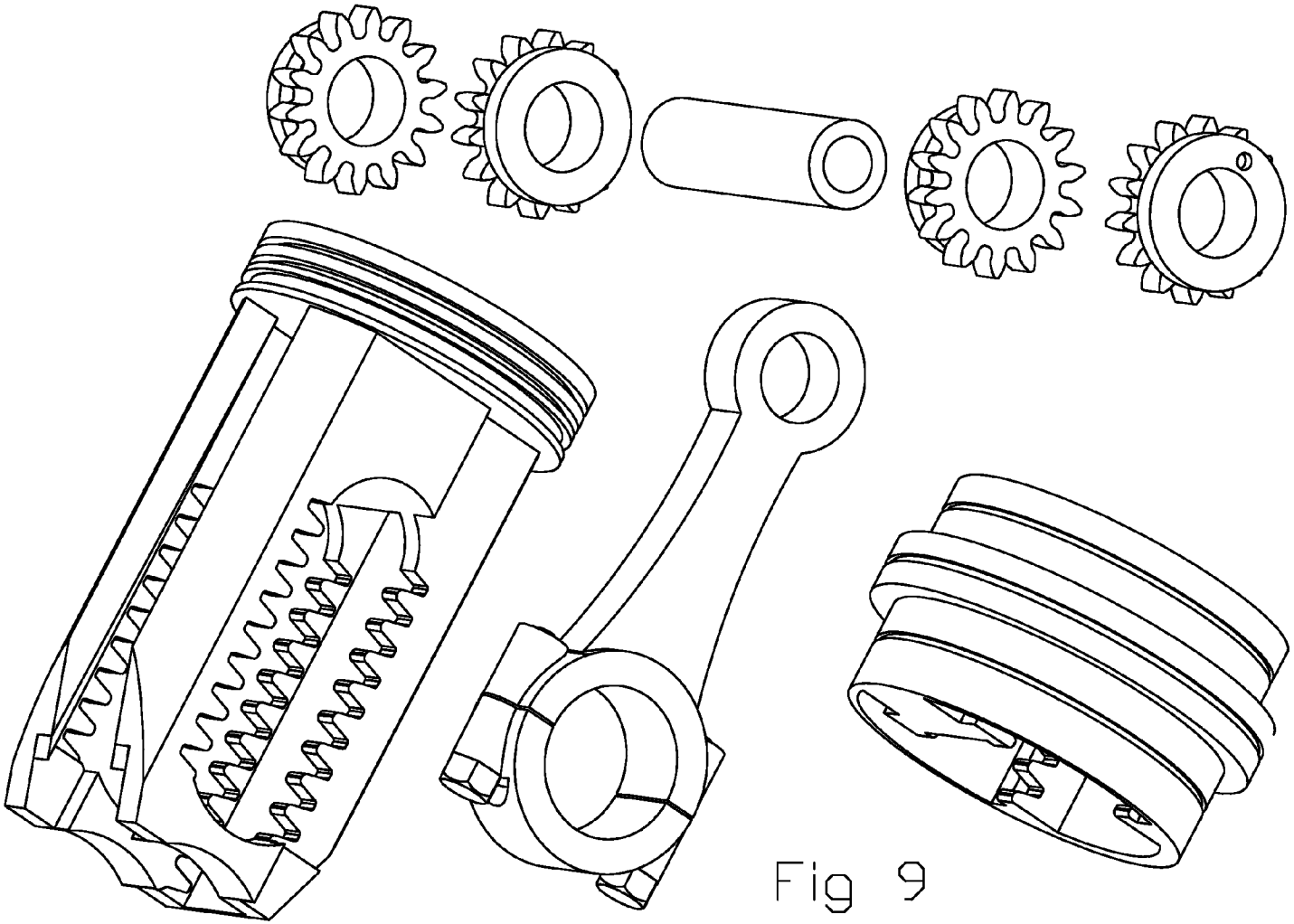
FIG. 9 shows the mechanism of FIG. 5 exploded.
Figure 10:
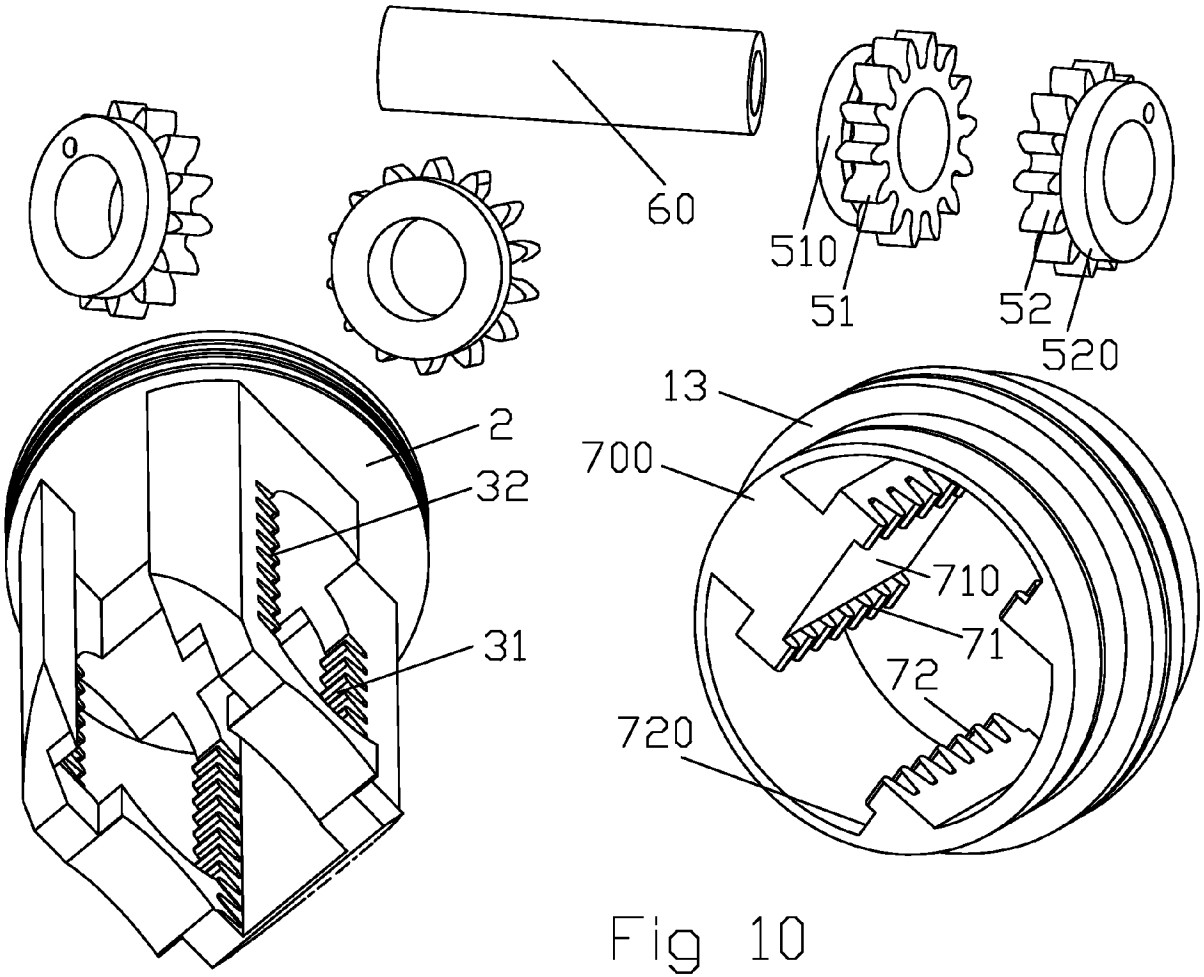
FIG. 10 shows the mechanism of FIG. 5 exploded.
Figure 12:
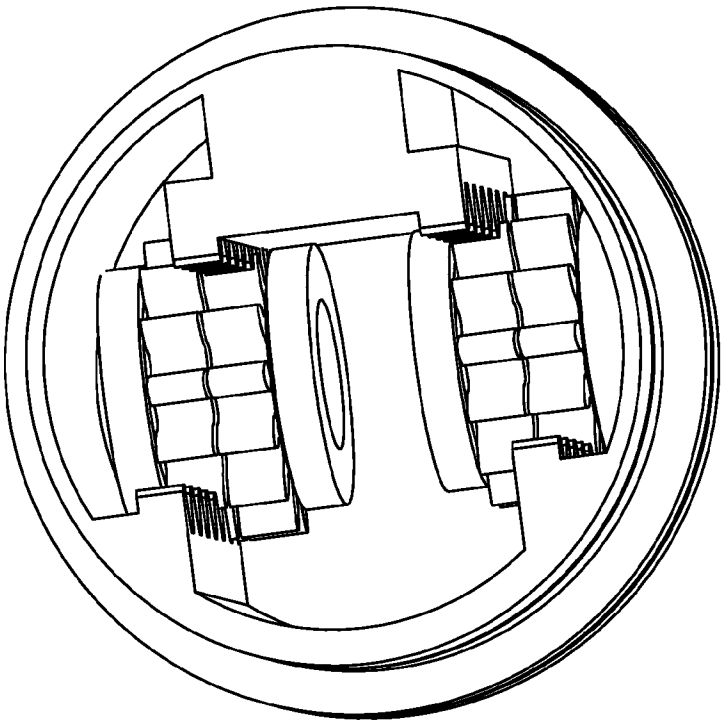
FIG. 12 shows the rack-frame, the gear wheels meshed with the control racks and the rollers of the gear wheels abutting on the rolling surfaces of the rack-frame.
Figure 11:
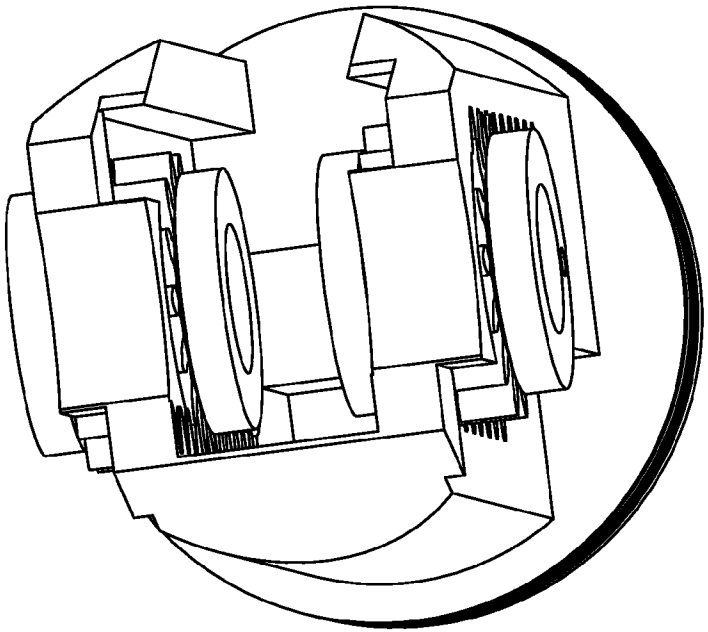
FIG. 11 shows the piston, the piston racks and the gear wheels meshed with the piston racks.
Figure 13:
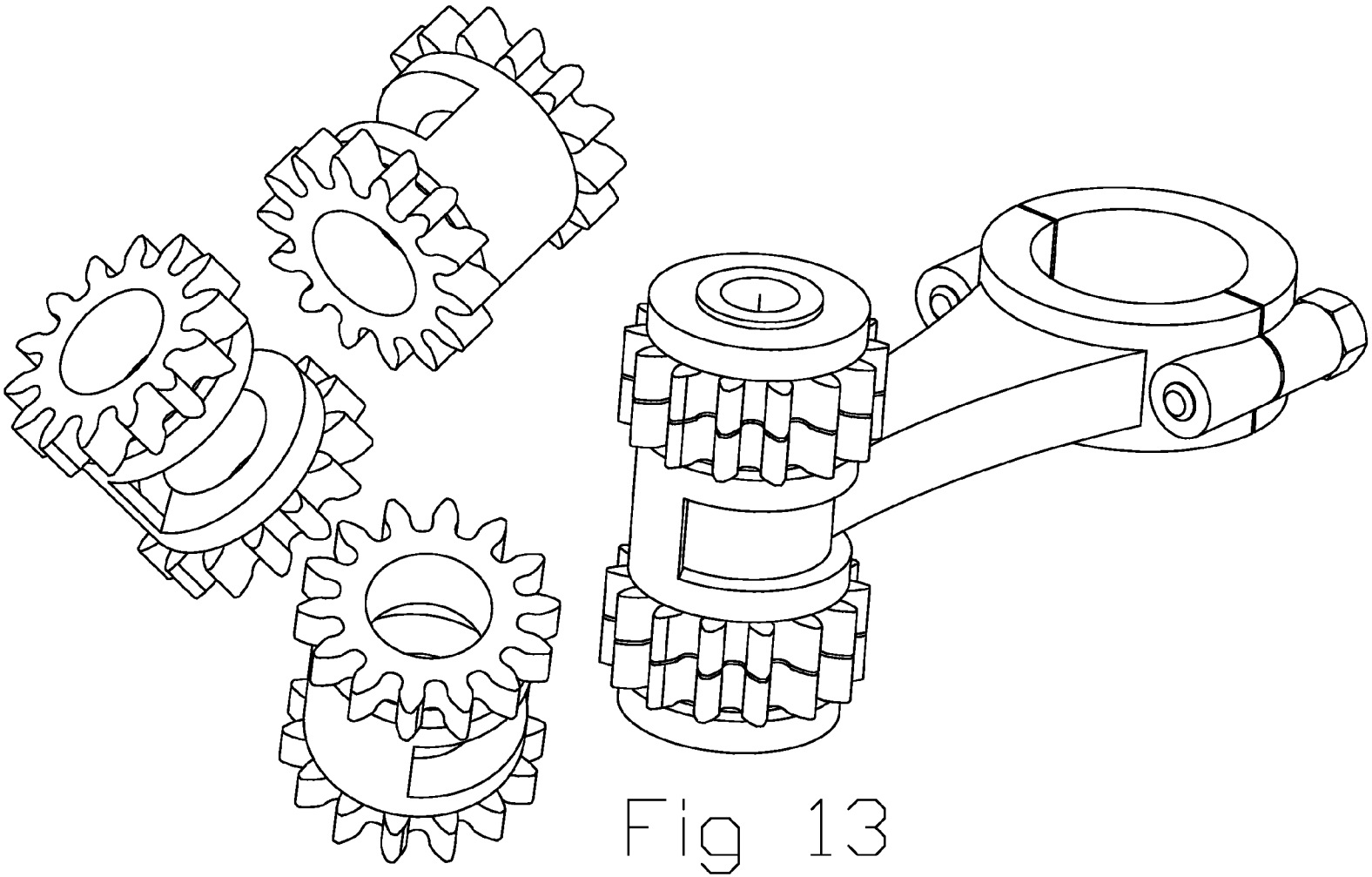
FIG. 13 shows at right the connecting rod and the gear wheels as mounted on the wrist pin. At left is shown, from various view points, the two inner gear wheels bridged/secured to each other by a rolling surface that also increases the loading capacity of the inner rollers during a part of the piston stroke.
Figure 14:
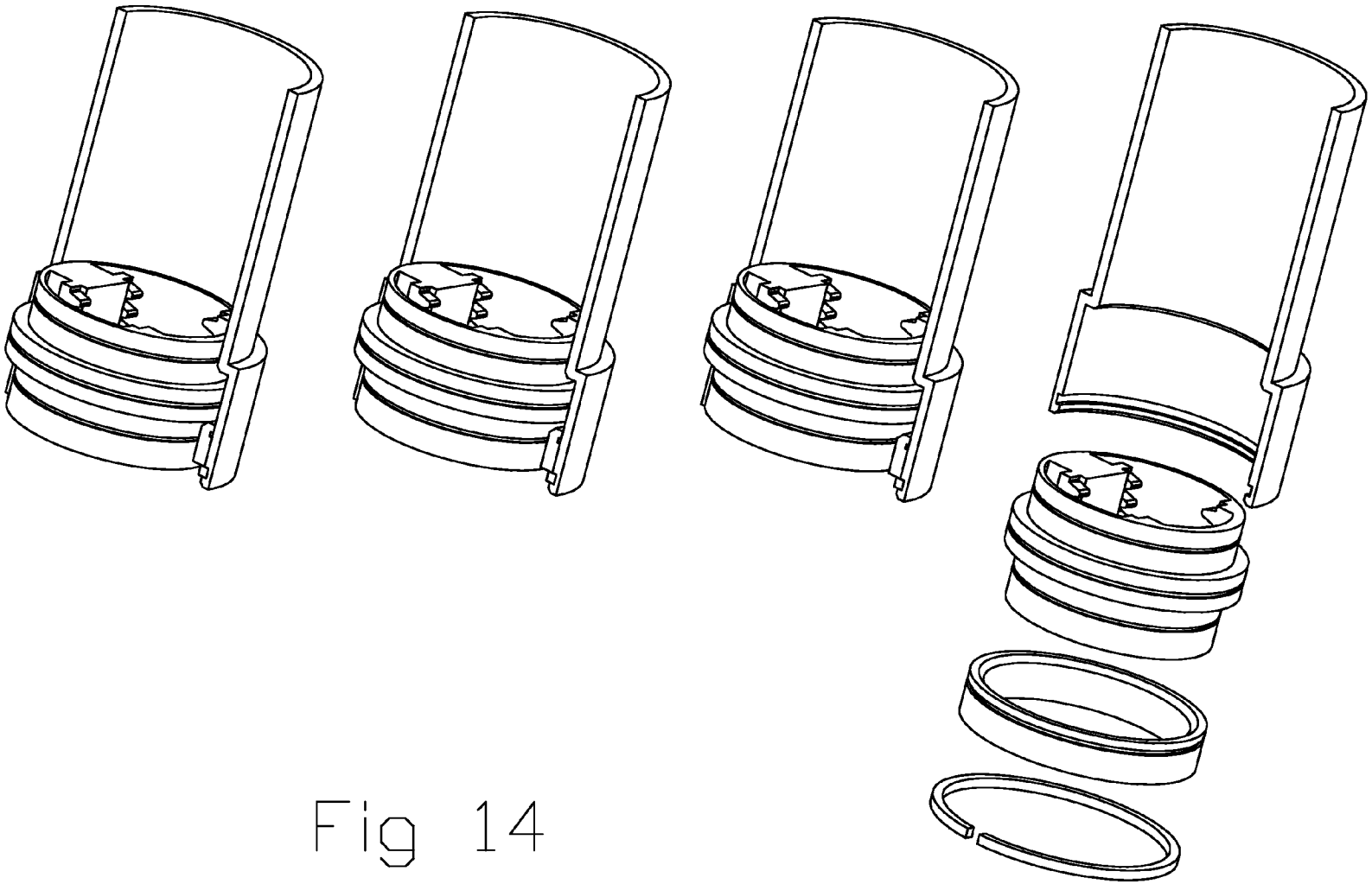
FIG. 14 shows the cylinder sliced with the rack-frame slidably mounted in it. From left to right: rack-frame at high compression ratio position, rack-frame at medium compression ratio position, rack-frame at low compression ratio position and exploded.
Figure 15:
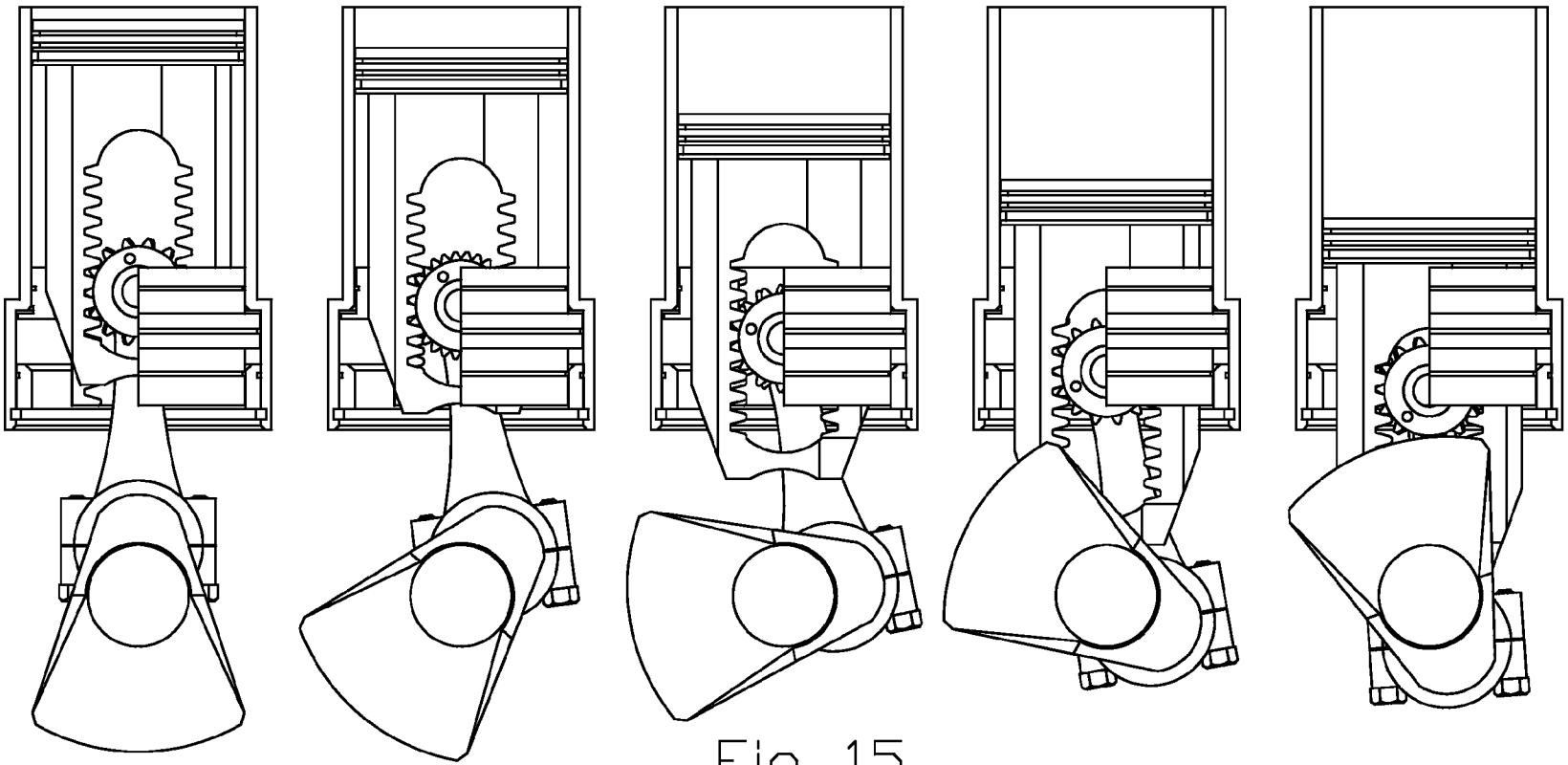
FIG. 15 shows the mechanism of FIG. 4 at low compression ratio, for five crankshaft angles.
Figure 16:
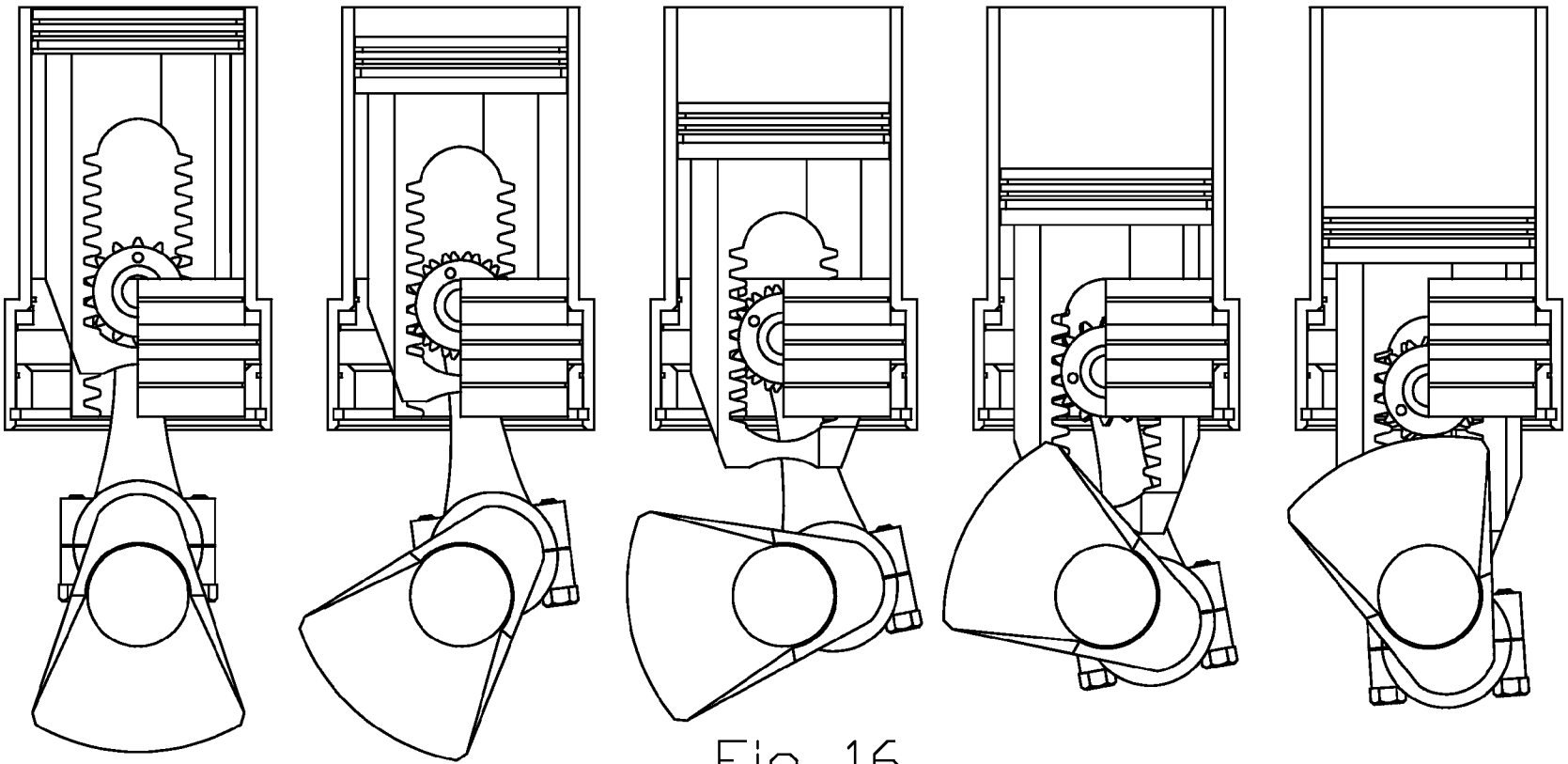
FIG. 16 shows the mechanism of FIG. 4 at high compression ratio, for five crankshaft angles.
Figure 18:
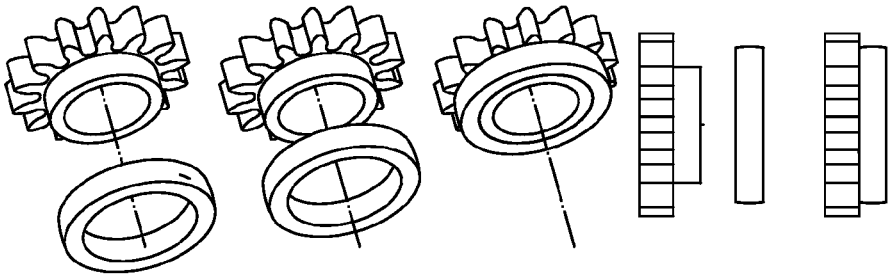
Figure 17:
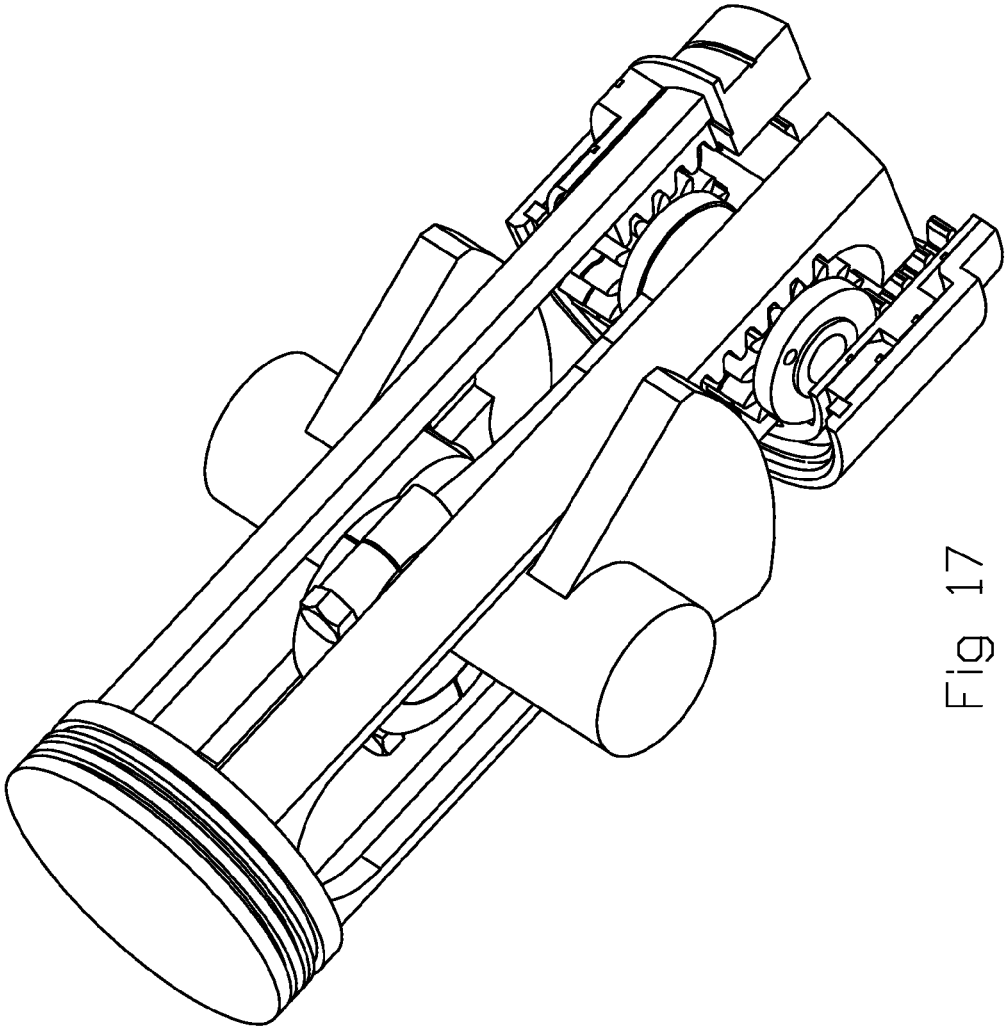
FIG. 17 shows a variation of the mechanism. The combustion is shifted to the slow dead center.

FIG. 18 shows details of the gear wheels and their roller. In this case the gear wheel has a hub. The roller is secured to the gear wheel hub by press to form a body.

FIG. 19 shows the first preferred embodiment at left versus the closest prior art, to demonstrate the downsizing. The two arrangements have the same piston stroke.

Figure 20:
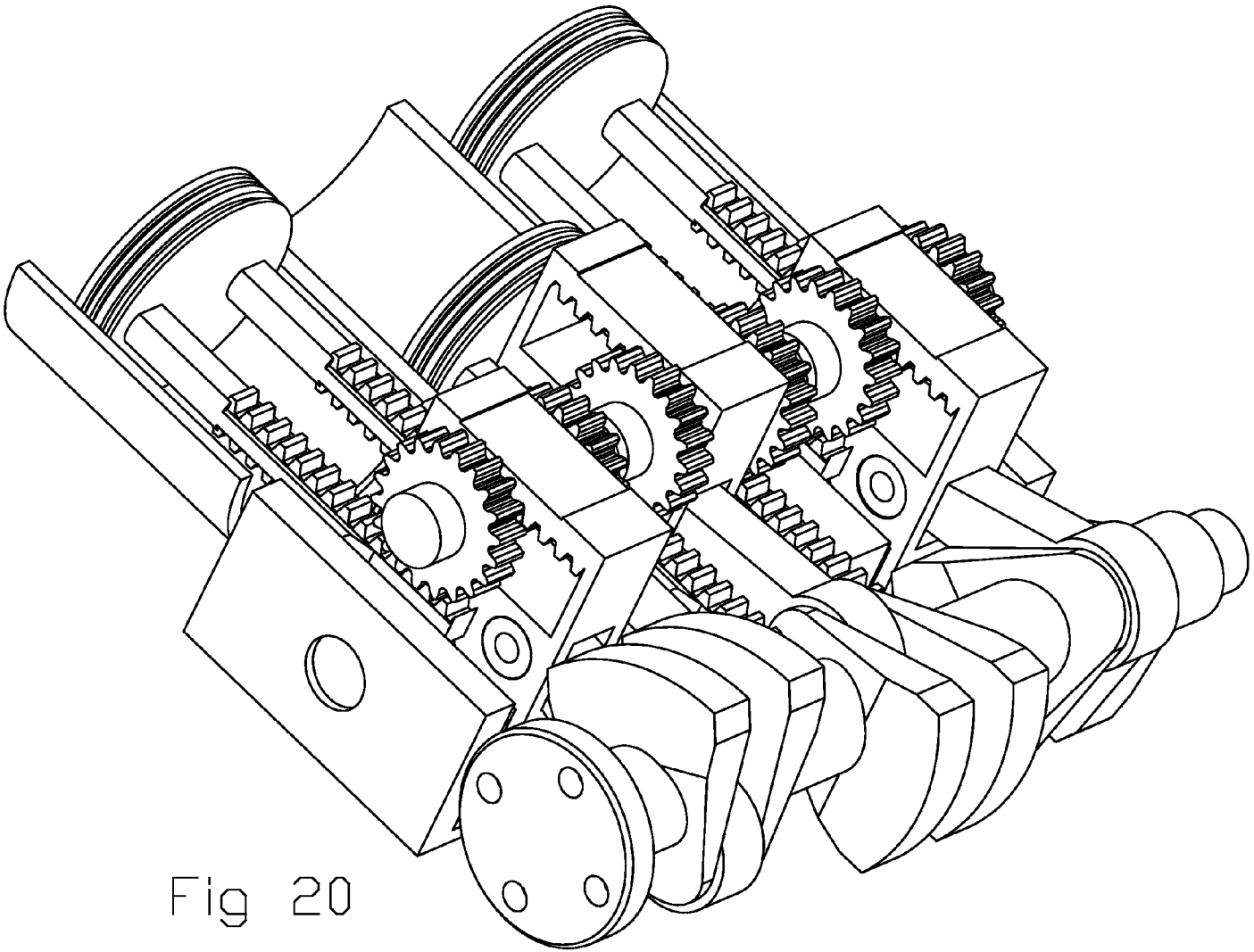

FIG. 20 shows a three cylinder in-line according a second preferred embodiment.

Figure 21:
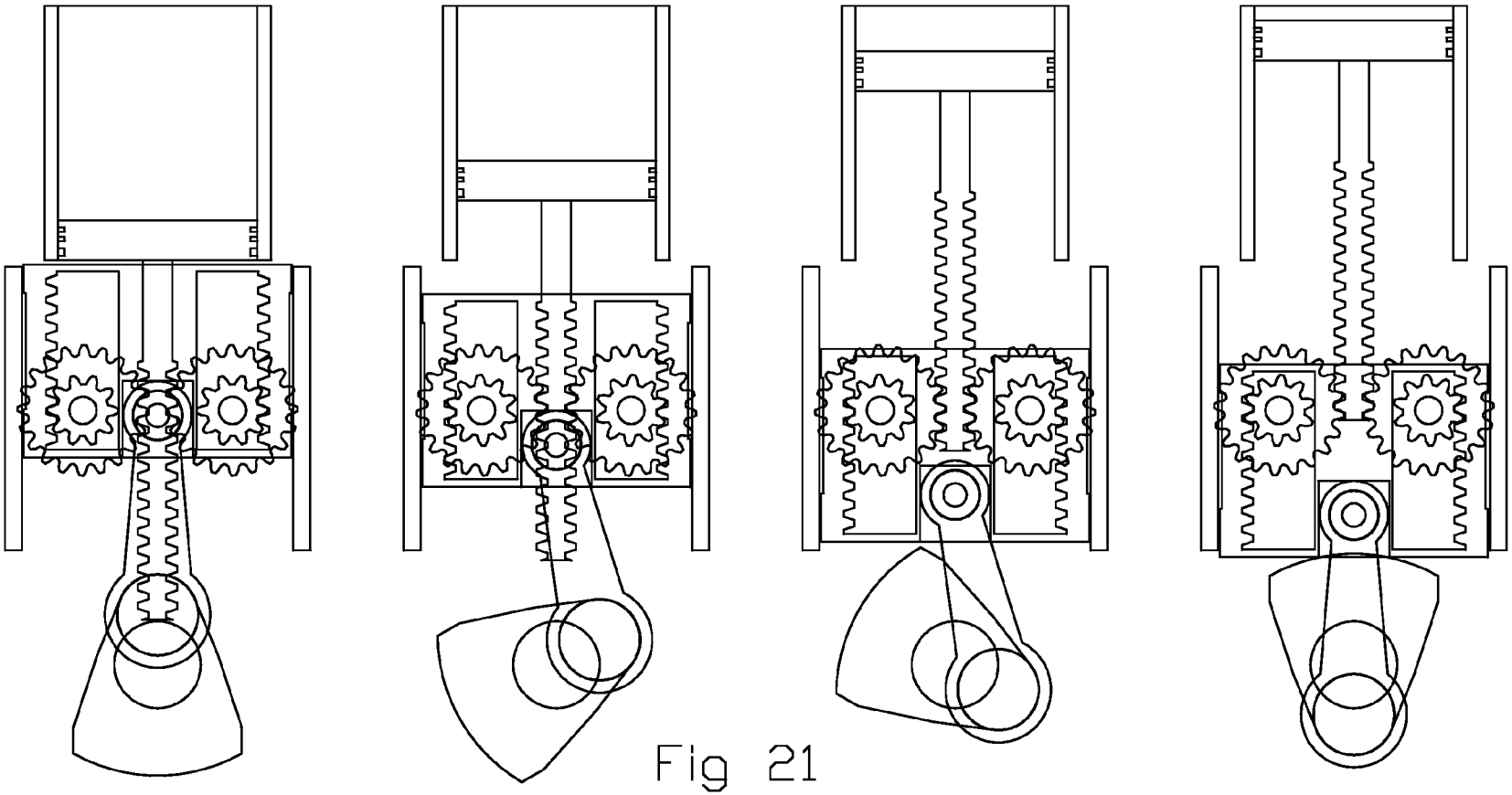

FIG. 21 shows the engine of FIG. 20 at four different crankshaft angles, for low compression ratio.

Figure 22:
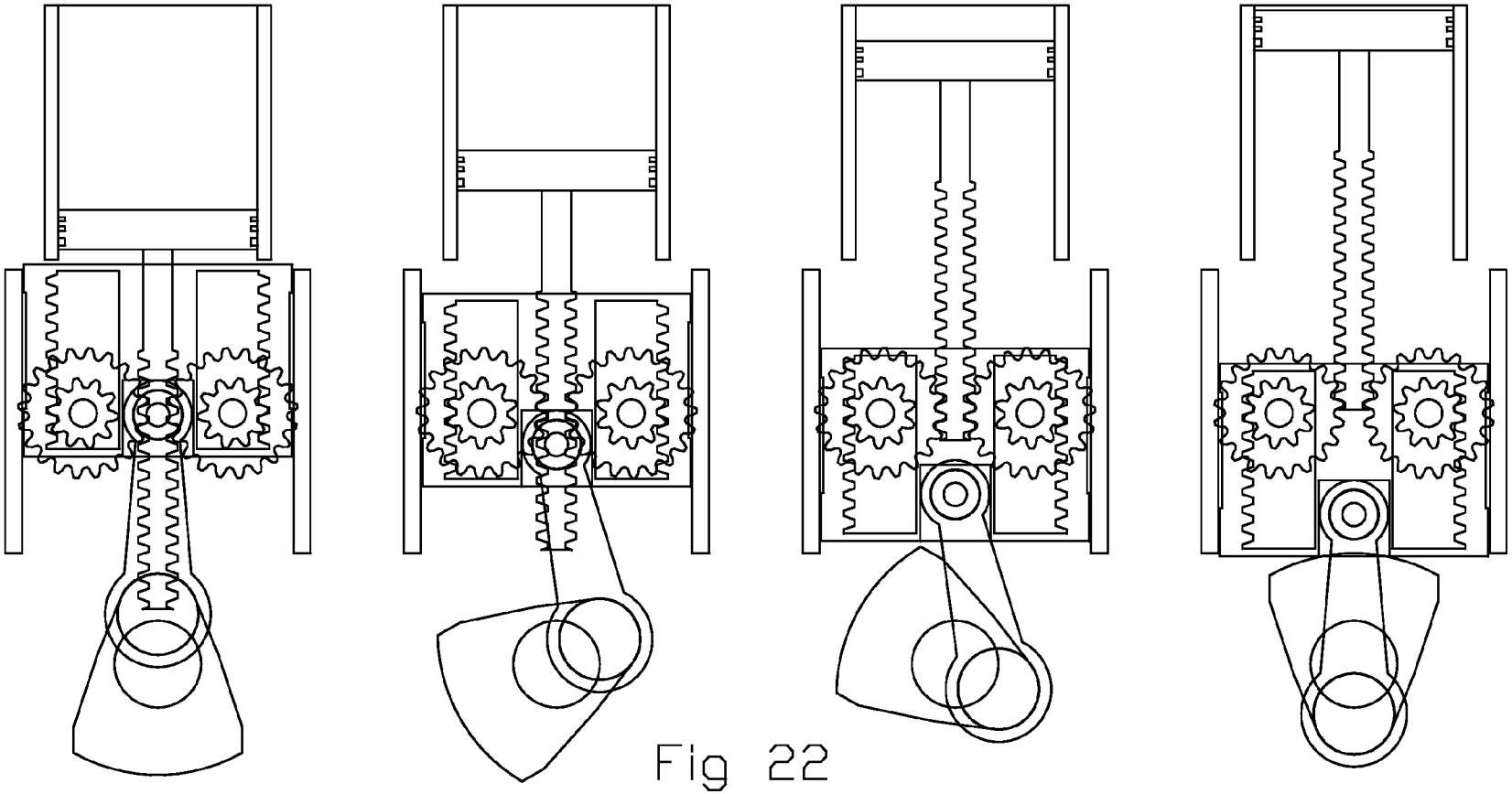

FIG. 22 shows the engine of FIG. 20 at four different crankshaft angles, for high compression ratio.

Figure 23:
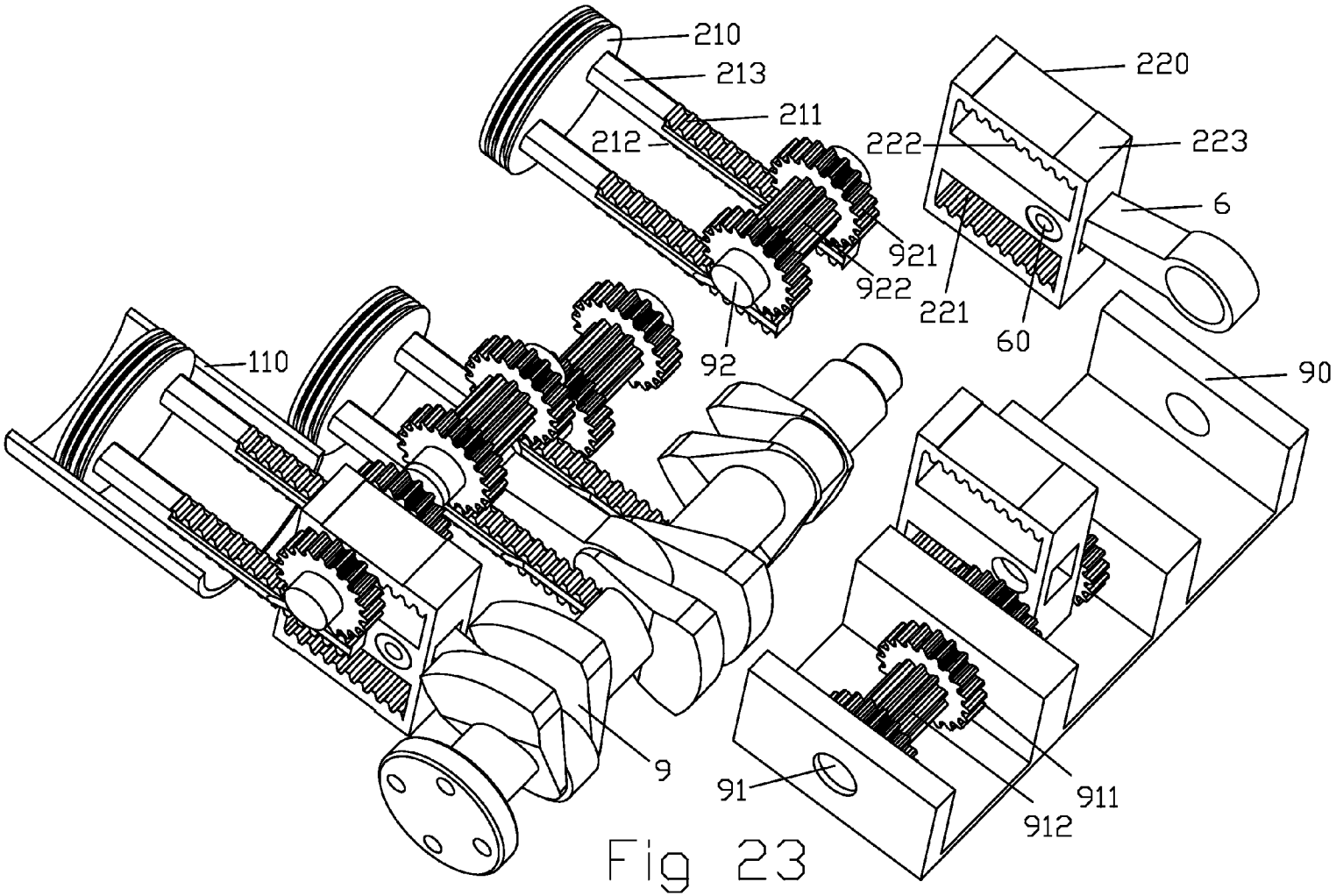

FIG. 23 shows the moving parts of the engine of FIG. 20 in more details. The gear-frame is sliced.

Figure 24:
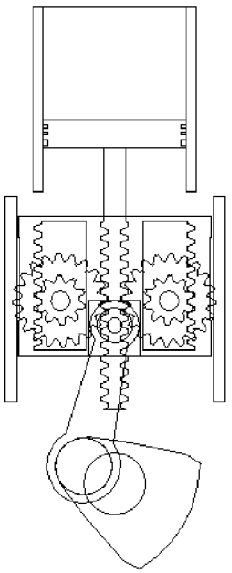

FIG. 24 shows a side view of a cylinder of the engine of FIG. 20. The rack-frame stroke to the piston stroke is selected to be 1:2.

Figure 25:
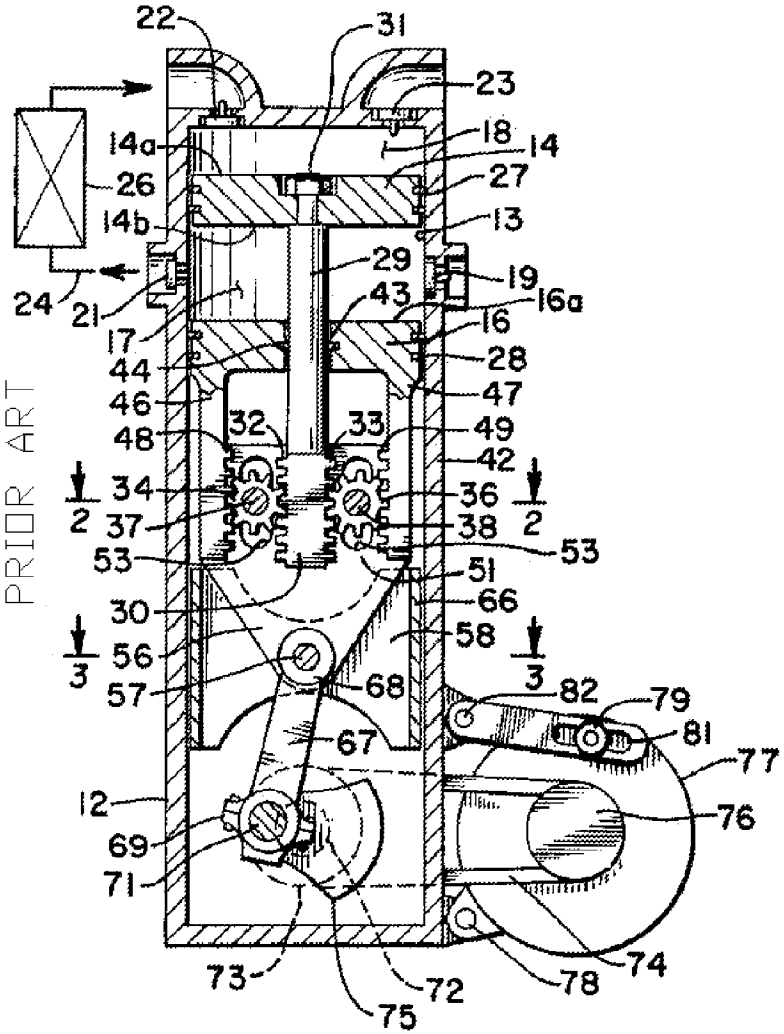

FIG. 25 shows the second closest prior art having same piston stroke with the engine of FIG. 24. The rack-frame stroke to the piston stroke of the engine of FIG. 25 is 1:1 and the resulting engine height, high.

Figure 26:
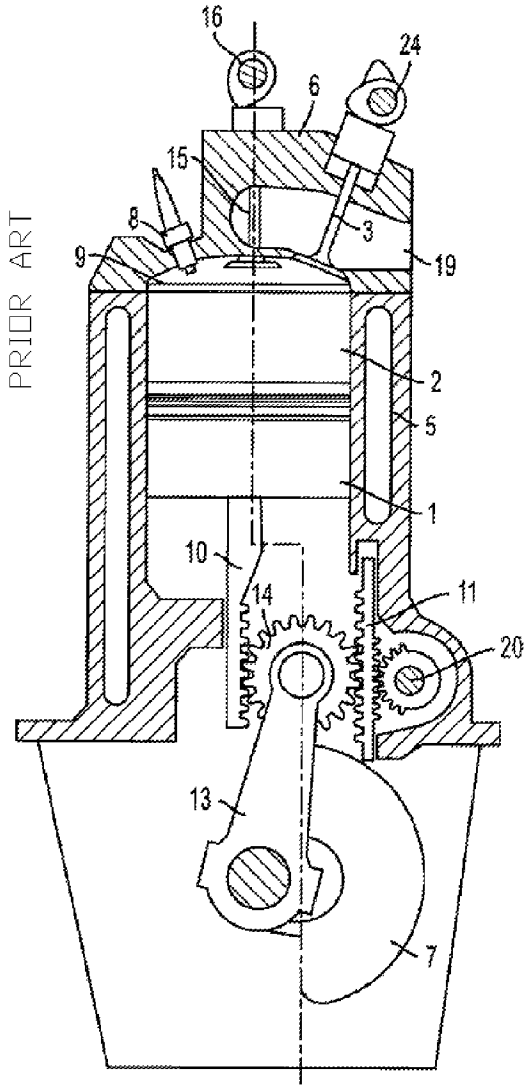
Figure 26:
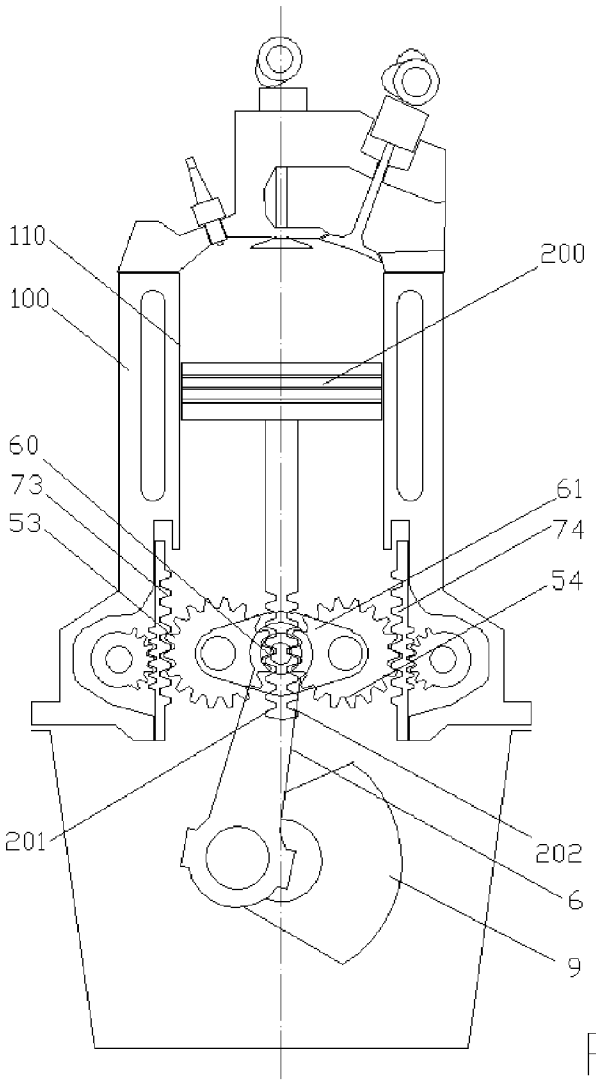

FIG. 26 shows a third preferred embodiment, left, in comparison to the closest prior art, right. The mechanism at left is symmetrical while the mechanism at right is one-sided.

Figure 27:
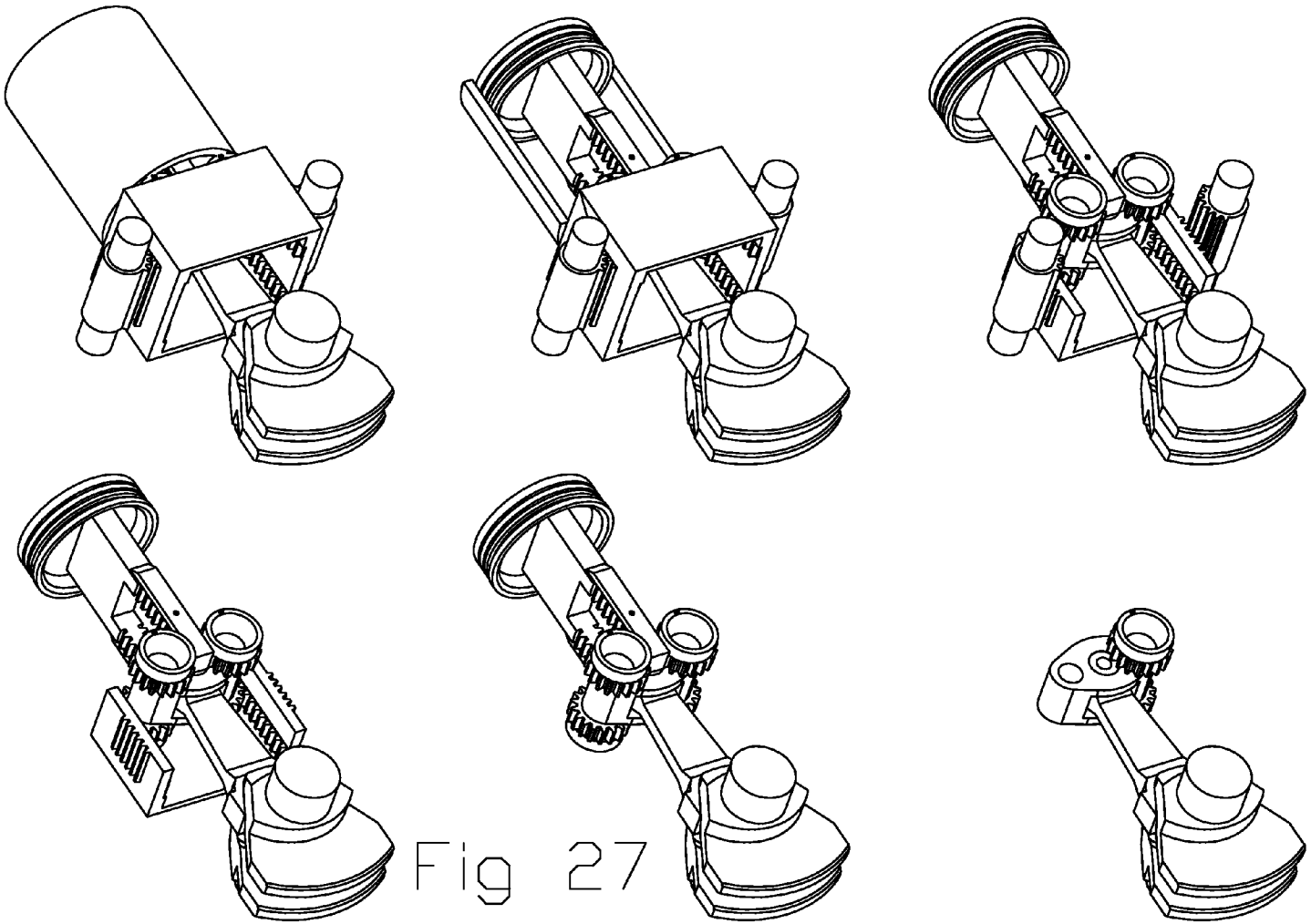

FIG. 27 shows, from top left to bottom right, the basic mechanism of the second embodiment complete, then with the cylinder sliced, then with the cylinder removed and the rack-frame sliced, then with the control gear shaft removed, then with the rack-frame removed, then with the piston and the left gear wheels/rollers removed.

Figure 28:
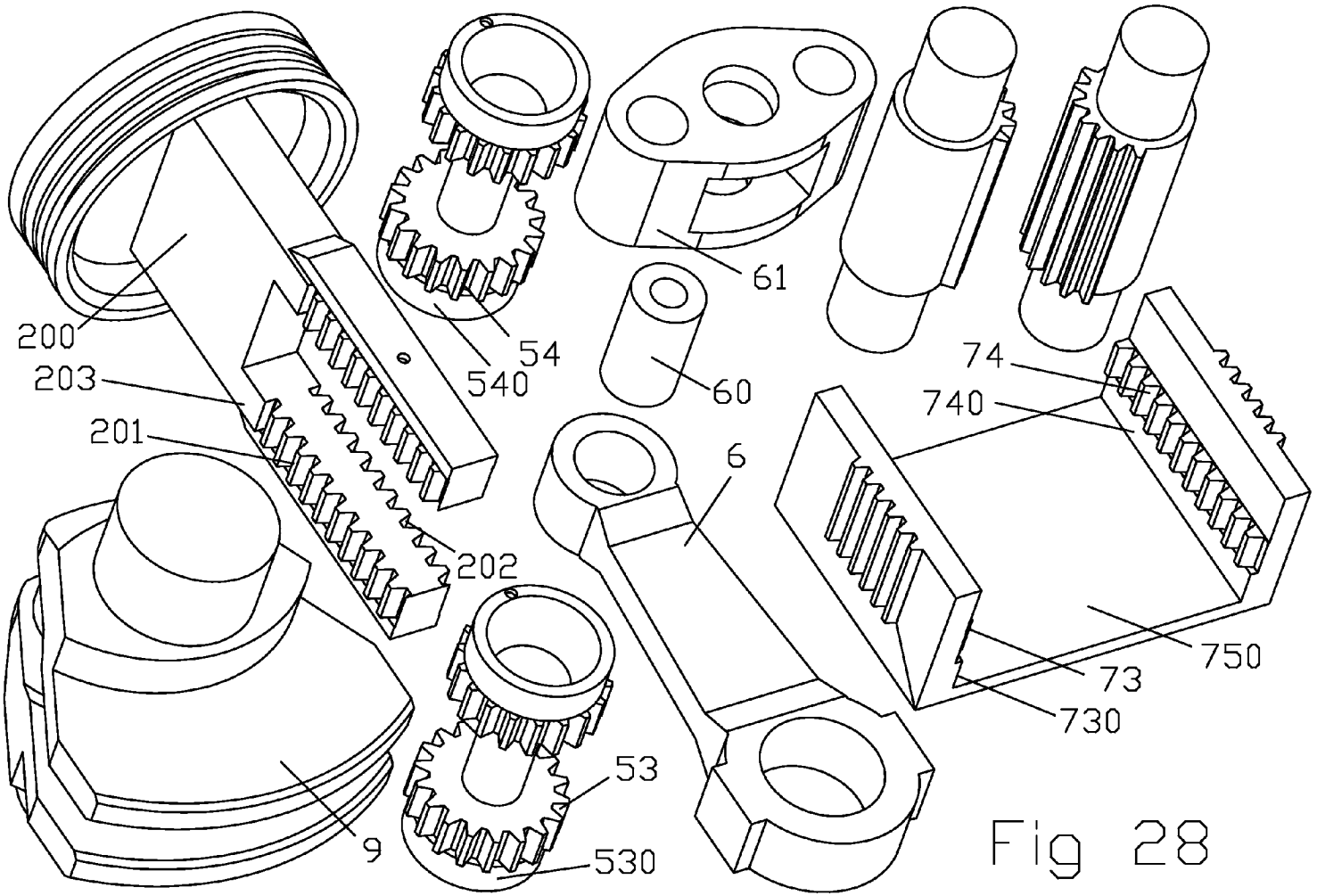

FIG. 28 shows the engine of FIG. 27 exploded. The rack-frame is sliced to show the control racks and the rolling surfaces on which the rollers abut. The cylinder is removed.

Figure 29:
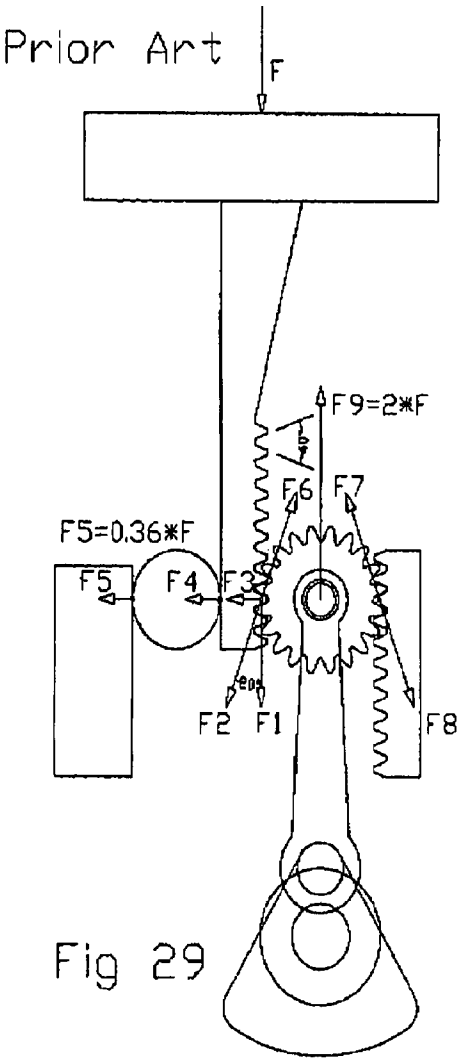

FIG. 29 shows the mechanism of the closest prior art, which is also shown in FIG. 19, and the resulting forces on the synchronized roller.

Figure 30:
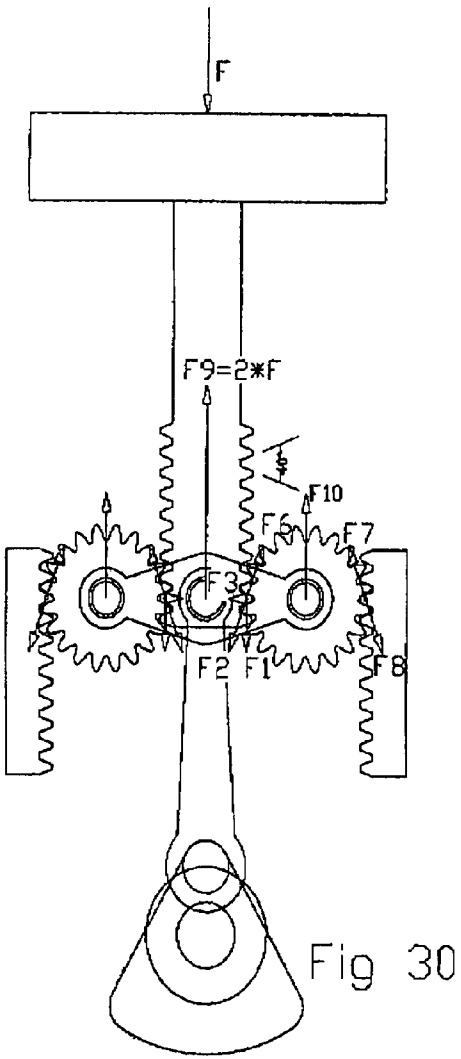

FIG. 30 shows, in comparison to FIG. 29, the third preferred embodiment and the relative forces that load the mechanism.

In a first preferred embodiment, shown in FIGS. 1 to 19, four piston racks, like 31, are secured to the piston head like the legs of a table. The two piston racks "look" at opposite direction than the other two. The piston racks are offset from each other and are bridged at their free ends for strength. At the small end of the connecting rod 6 they are rotatably mounted, by the wrist pin 60, four gear wheels like 51, each one comprising a roller, like 510, of diameter equal to the pitch circle diameter of the gear wheel. Each one of the four gear wheels meshes at one side with a piston rack and at the opposite side with a control rack, like 71. The rollers of the gear wheels abut along rolling surfaces like 710, besides the control racks and transfer the trust loads from the connecting rod to the casing by rolling, for lower friction. The piston stroke is twice as long as the wrist pin stroke. Displacing the control racks by x, along the cylinder axis, the dead volume changes by $x*D*D*\pi/4$, where D is the cylinder diameter, and the compression ratio changes accordingly. A cylindrical rack-frame 700 holds the control racks and the rolling surfaces, and comprises a control piston 13. The rack-frame is slidably fitted into a cylinder. Feeding oil at one side and removing oil from the other side of the control piston, the compression ratio changes.

In U.S. Pat. No. 7,562,642 the block, in order to house the additional cylinders for the hydraulic control and the big gear wheels, is almost double in width than conventional, while the crankshaft axis is away from the cylinder axis. In the present invention the engine block remains similar in size and weight to the conventional of same capacity, while the crankshaft axis remains as close to the cylinder axis as desirable.

In U.S. Pat. No. 7,562,642 and U.S. Pat. No. 6,354,252, the one-sided piston rack generates significant thrust loads on the piston rack and on the synchronized roller. The surface of each tooth of the rack is inclined by an angle f, typically some 20 degrees, relative to the vertical to the cylinder axis plane. When a tooth of the big gear abuts on a tooth of the rack to apply a force F along the cylinder axis, the inclination of the tooth surface of the rack generates a vertical to the cylinder axis force of F*tan(f), which is about F/3. At TDC, for instance, where the inertia force of the piston is at its maximum value Fmax and the connecting rod is parallel to the cylinder axis, the inclination of the piston rack teeth surface inevitably generates a heavy trust load of about Fmax/3 that loads the casing that needs reinforcement for stiffness.

In the conventional engine, in comparison, when the piston is at TDC and the inertia force from the piston is maximized, there is no thrust load because the connecting rod is parallel to the cylinder axis. After 45 degrees the second order inertia force is zero, the first order inertia force is 70% of its maximum value, the inclination of the connecting rod is only some 10 degrees from the cylinder axis, and the inertia thrust load is maximized being less than one third, for the same piston stroke and the same piston mass.

In the present invention the total, normal to the cylinder axis, force from the gear wheels to the piston racks is zero. The gear wheels and the rollers are way smaller and lighter. The inertia loads and the gas pressure loads on the piston are equally shared among the four piston racks that push the teeth of the four gear wheels, i.e. each gear wheel carries one quarter of the piston load. The control racks support the anti-diametrical teeth of the gear wheels. The inclination of the surface of the piston rack teeth generates vertical to the cylinder axis forces on the four gear wheels that are taken by the wrist pin. The two of these forces are at opposite direction than the other two, giving a zero total force on the wrist pin. This is highly advantageous because the rollers of the gear wheels are released from the heavy loads of the rollers of the closest prior art, and carry only the thrust loads that result from the inclination of the connecting rod. The maximum force on the roller is less than ⅓ of the maximum force on the roller of the closest prior art, allowing way lighter, yet more reliable, rollers.

The four control racks together with the rolling surfaces are integrated into a strong cylindrical rack-frame 700 tightly supported into the cylinder. Only when a different compression ratio is desired, only then the rack-frame has to slightly move along the cylinder. The rack-frame, together with the wrist pin and the gear wheel rollers, resemble to a special purpose roller bearing and can be made as a unit independently. This is advantageous compared to the closest prior art where a spring adjuster, located away from the cylinder axis and supported on the block, supports the backside of the control rack, then a flat surface on the front size of the control rack supports the big gear roller, then the big gear roller supports anti-diametrically the front plane surface of the piston rack, then a flat surface on the backside of the piston rack supports the synchronized roller which is finally supported by an adjustable plane surface on the block. The block needs extra strength to avoid the oscillation of this "series" of parts. The necessary, for the high revs and the heavy load operation, spring preloading adds friction and wear at partial loads and at low revs. In a second preferred embodiment, FIGS. 20 to 25, the piston has two pillars like 213, each one having two racks, like 211 and 212, "back to back". The piston racks are symmetrically loaded. There are two shafts, like 91 and 92, each one having gear wheels, like 911 and 912, secured to it, with the one gear wheel substantially smaller in diameter. The gear wheel shafts are rotatably mounted on a gear wheel casing 90 properly supported on the casing. A rack-frame 220, comprising racks, like 221 and 222, is pivotally mounted at the small end of the connecting rod 6 by a wrist pin 60, like a conventional piston. The rack-frame has sliders 223, like the piston skirt, for passing the thrust loads. The rack-frame racks are meshed with the smaller gear wheels, like 912, while the piston racks are meshed with the bigger gear wheels, like 911.

The rotation of the crankshaft causes the reciprocation of the rack-frame that causes, by means of the racks of the rack-frame, the rotational oscillation of the gear wheels that cause, by means of the piston racks, the reciprocation of the piston.

The rack-frame reciprocates in opposite direction than the piston. Selecting properly the ratio between the pitch circle of the small gear wheels and the pitch circle of the big gear wheels, the per cylinder free total inertia force becomes zero. For instance with 1:2 ratio of small gear wheel to big gear wheel pitch circle diameter, the piston stroke is twice the rack-frame stroke. In case the total mass of the rack-frame together with the wrist pin and of the reciprocating part of the connecting rod (about ⅓ of the total connecting rod mass) is equal to 2*m, where m is the total mass of the piston with the piston racks, the single cylinder is absolutely balanced as regards its inertia forces, thereby a three cylinder in-line becomes, without any balance shaft, as balanced as the conventional six in-line, and a five cylinder in-line becomes, without any balance shaft, as vibration free as the best V12 and the rotary Wankel engine.

A connecting rod of mass M is equivalent, as regards the inertia forces, with two spot masses, a mass M1 that reciprocates with the piston, located at connecting rod's small end center and a mass M2 rotating with the crankpin and located at connecting rod's big end center, where M1+M2=M and the center of gravity of the set of the M1 and M2 masses being the same with the center of gravity of the connecting rod.

By displacing the control-frame for a distance x along the cylinder axis, the dead volume changes by $3*x*D*D*\pi/4$, where D is the cylinder diameter, and accordingly the compression ratio.

In the U.S. Pat. No. 3,861,222 the piston stroke and the rack-frame stroke are equal because the same gear wheel is meshed at one side with the piston racks and at the opposite side with rack-frame racks.

The opposite reciprocation of piston relative to the reciprocation of the rack-frame causes a significant increase of the engine height for specific piston stroke. This is because the moment the piston is at its lower position, the rack-frame is at its top position. The symmetrical loading of the piston racks enables lightweight, yet robust, piston structure. The opposite happens for the rack-frame: its racks are one-sided loaded which means need for heavy structure to avoid bending, the racks have to be secured to each other by traverse beams, the wrist pin and the upper part of the connecting rod reciprocate together with the rack-frame. As a result, the inertia loads on the connecting rod become a few times heavier than those in the conventional engine of same stroke and same piston mass, the high revving capability of the engine degrades and the friction increases. In order to counterbalance the inertia forces of the rack-frame together with the wrist pin and the reciprocating part of the connecting rod, the piston needs to be loaded with additional mass, which is undesirable.

To solve the previous problems, the gear wheels meshed with the piston racks have substantially bigger pitch circle diameter, double in the embodiment shown, than the gear wheels meshed with the racks on the rack-frame. Besides the substantial reduction of the engine height and of the inertia loads, because the heavy parts perform shorter stroke, the friction is also reduced because the inertia loads are lighter and because the speed of the rack-frame slider is half than the piston speed.

The opposite reciprocation of the piston than the rack-frame shifts the combustion to the slow dead center providing additional time to the mixture to get prepared and burned in better conditions, increasing the constant volume portion of combustion, as happens also in the engine proposed in PCT/EP2007/050809. The peak power revs of compression ignition engines can increase, and proportionally the peak power, while the connecting rod is heavily loaded only in tension.

In a third preferred embodiment, shown in FIGS. 26 to 30, at the small end of the connecting rod 6 is pivotally mounted, by the wrist pin 60, a carriage 61 having two bearings on which two double gear wheels, 53 and 54, are pivotally mounted. The gear wheels comprise rollers, 530 and 540, of diameter equal to the pitch circle diameter of the gear wheels. The piston has two projections/legs like 203, each one having two "back to back" piston racks like 201 and 202. The gear wheels are meshed with the piston racks at one side, and with control racks, like 73 and 74, at the opposite side, while the rollers abut on rolling surfaces, like 730 and 740, besides the control racks and optionally on rolling surface on the piston.

The control racks and the rolling surfaces are integrated in a strong rack-frame structure 750. The piston racks in combination with the piston skirt, the cylinder wall, the control racks and the gear wheels prevent the carriage from rotating about the wrist pin. On each "back to back" double piston rack, like the 201/202, the vertical to the cylinder axis force, generated by the inclination of the surface of the teeth of the one rack, is reacted/counterbalanced by the opposite force on the opposite rack. This allows more robust, yet lighter, piston structure, necessary for high revving.

The inclination of the surface of the piston rack teeth generates forces on the gear wheel, vertical to the cylinder axis. These forces pass to the carriage and counterbalance the equal and opposite forces on the carriage from the symmetrical gear wheel. This way the rollers have to pass to the rolling surfaces only the thrust loads that are caused by the inclination of the connecting rod, way lighter than the thrust loads on the gear wheels because of the inclination of the piston rack teeth surface.

The control racks and the rolling surfaces are integrated in a rack-frame 750 that slides abutting on proper guides on the engine casing. Displacing the control rack casing along the cylinder axis, for instance mechanically by rotating the two gear shafts, the dead volume changes and consequently the compression ratio.

Compared to the conventional engine of same piston stroke and same cylinder bore, this arrangement is similarly compact and lightweight, it moreover varies continuously the compression ratio and takes the thrust loads by pure rolling of synchronized rollers on rolling surfaces, which means reduced friction and simple piston structure. Compared to the closest prior art, the maximum force that loads the roller is many times lighter as is explained below.

FIG. 29 shows the closest prior art with the piston at TDC, while FIG. 30 shows the third preferred embodiment with the piston at TDC. The rack teeth angle is taken 20 degrees, which is a typical value. As regards the inertia loads on the roller at TDC: F is the inertia force that has to be applied on the piston to accelerate it to the middle stroke. In FIG. 29 the teeth of the gear wheel apply a force F2 on the piston rack. F2 is 20 degrees inclined from the cylinder axis, because 20 degrees is the angle of the rack teeth surface from the vertical to the cylinder axis plane. The component of the F2 along the cylinder axis is F1=F2*cos(20°)=0.94*F2=F and accelerates the piston to perform the reciprocation it does. The other component, vertical to the cylinder axis, of the F2 is F3=F2*sin(20°)=0.34*F2=0.34*(F/0.94)=0.36*F and pushes the piston rack to the left, applying the force F4=F3 on the roller, and finally the roller applies a force F5=F4=F3 to the flat surface at left. I.e. at TDC, where the inertia force F to the piston takes its maximum value F, the roller is loaded by more than one third of the force F. To apply the force F2 on the piston rack, the gear wheel is loaded by an equal and opposite force F6 from the piston rack and a force F7, with F7=F6 in case of zero inertia of the gear wheel, from the control rack at right. The sum of the F6 and F7 forces on the teeth of the gear wheel is the force F9=2*F and is applied on the wrist pin.

In comparison, in FIG. 30 the piston rack takes a force F2 from the right gear wheel and an equal and symmetrical, about the cylinder axis, force from the left gear wheel. The component F1 of F2 parallel to the cylinder axis equals to F/2. The component F3 of F2 vertical to cylinder axis equals to 0.36*F/2. The left gear applies to the piston rack an equal and opposite to F3 force, and the piston rack needs not thrust support. The total force on the right gear wheel from the piston rack and from the control rack is F10=F, and the total force from the two gear wheels on the carriage that is pivotally mounted at the small end of the connecting rod is F9=2*F. I.e. the rollers of the new arrangement are unloaded at TDC.

As regards the gas pressure loads on the rollers at TDC: Now in FIG. 29 F is the force applied on the piston by the compressed gas. To receive the force F1=F, the teeth of the gear wheel apply on the piston rack a vertical to the cylinder axis force F3=F*0.36. This is because the surface of the teeth of the piston rack is not vertical to the cylinder axis. The piston rack presses the roller with a force F4=F3 and the roller abuts on the right rolling surface with a force F5=F4=F3=0.36*F. I.e. at TDC the high pressure into the cylinder creates a heavy load on the roller.

In comparison, FIG. 30, the gas pressure generates a force F on the piston. In order to receive this force, the right gear wheel applies a force F3=0.36*F/2 on the rack gear normal to the cylinder axis. The left gear applies an equal to F3 and opposite force on the piston rack. The total thrust load on the piston rack is zero, i.e. the rollers stay unloaded at TDC.

In the new mechanism the loads on the rollers are generated from the inclination of the connecting rod. The maximum inclination of the connecting rod happens with the crank pin at 90 degrees after TDC, where neither the inertia forces nor the gas pressure forces on the piston are heavy, moreover the maximum inclination of the connecting rod is small compared to the inclination of the teeth of the piston rack. The inclination of the connecting rod is even smaller when the gas pressure force and or the inertia force on the piston are strong, i.e. near TDC. This results in a more than three times lower maximum load on the roller of the new arrangement than in the closest prior art, allowing way lighter, yet robust and reliable, rollers and less friction.

Although the invention has been described and illustrated in detail, the spirit and scope of the present invention are to be limited only by the terms of the appended claims.

What is claimed is:

1. A reciprocating variable compression ratio engine comprising at least:

a casing (100);

a crankshaft (9);

a connecting rod (6);

a wrist pin (60);

a cylinder (110);

a piston (2) movable within said cylinder (110), said piston (2) comprising a first piston rack (31) and a second piston rack (32), said first piston rack (31) having teeth at opposite direction than the direction of the teeth of said second piston rack (32);

a first control rack (71) and a second control rack (72);

a first gear wheel (51) and a second gear wheel (52), said first gear wheel (51) and said second gear wheel (52) being pivotally mounted at one end of said connecting rod (6) by said wrist pin (60), said first gear wheel (51) being meshed at one side to said first piston rack (31) and at its opposite side to said first control rack (71), said second gear wheel (52) being meshed at one side to said second piston rack (32) and at its opposite side to said second control rack (72);

a first rolling surface (710) and a second rolling surface (720);

a first roller (510) secured to said first gear wheel (51), said first roller (510) having diameter substantially equal to the pitch circle diameter of said first gear wheel (51), said first roller (510) abutting on said first rolling surface (710);

a second roller (520) secured to said second gear wheel (52), said second roller (520) having diameter substantially equal to the pitch circle diameter of said second gear wheel (52), said second roller (520) abutting on said second rolling surface (720), wherein the displacement of the control racks changes the compression ratio and the two-sided piston rack structure substantially reduces the forces that load the rollers.

2. A reciprocating variable compression ratio engine according claim 1 wherein the cylinder axis offset from the crankshaft axis is smaller than one sixth of the cylinder diameter.

3. A reciprocating variable compression ratio engine according claim 1 wherein the control racks and the rolling surfaces are integrated into a cylindrical frame (700) slidably mounted in a cylinder of the casing.

4. A reciprocating variable compression ratio engine comprising at least:

a casing (100);

a crankshaft (9);

a connecting rod (6);

a wrist pin (60);

a carriage (61) pivotally mounted at one end of said connecting rod (6) by said wrist pin (60);

a cylinder (110);

a piston (200) movable within said cylinder (110), said piston (200) comprising a projection (203) having a first piston rack (201) at one side and a second piston rack (202) at its opposite side;

a first control rack (73) and a second control rack (74);

a first gear wheel (53) pivotally mounted on said carriage (61) and a second gear wheel (54) pivotally mounted on said carriage (61), said first gear wheel (53) being meshed at one side to said first piston rack (201) and at its opposite side to said first control rack (73), said second gear wheel (54) being meshed at one side to said second piston rack (202) and at its opposite side to said second control rack (74);

a first rolling surface (730) and a second rolling surface (740);

a first roller (530) secured to said first gear wheel (53), said first roller (530) having diameter substantially equal to the pitch circle diameter of said first gear wheel (53), said first roller (530) abutting on said first rolling surface (730);

a second roller (540) secured to said second gear wheel (54), said second roller (540) having diameter substantially equal to the pitch circle diameter of said second gear wheel (54), said second roller (540) abutting on said second rolling surface (740), wherein the displacement of the control racks changes the compression ratio and the two-sided piston rack structure substantially reduces the forces on the rollers.

5. A reciprocating variable compression ratio engine according claim 4 wherein the cylinder axis offset from the crankshaft axis is smaller than one sixth of the cylinder diameter.

6. A reciprocating variable compression ratio engine according claim 4 wherein the control racks and the roiling surfaces are integrated into a frame (750) slidably mounted in the casing.

7. A reciprocating variable compression ratio engine comprising at least:

a casing;

a crankshaft (9);

a connecting rod (6);

a wrist pin (60);

a rack-frame (220) pivotally mounted at one end of said connecting rod (6) by said wrist pin (60), said rack-frame (220) comprising a first rack (221) and a second rack (222), said rack-frame (220) comprising sliders (223) to pass the thrust loads;

a cylinder (110);

a piston (210) movable within said cylinder (110), said piston (210) comprising a projection (213) having a first piston rack (211) at one side and a second piston rack (212) at its opposite side;

a gear wheel casing (90);

a first gear shaft (91) pivotally mounted on said gear wheel casing (90), said first gear shaft (91) comprising two gear wheels (911) and (912) of substantially different pitch circle diameter, the gear wheel with the bigger pitch circle diameter (911) being meshed to one of said piston racks, the gear wheel (912) with the smaller pitch circle diameter being meshed to one of said racks of said rack-frame (220);

a second gear shaft (92) pivotally mounted on said gear wheel casing (90), said second gear shaft (92) comprising two gear wheels (921) and (922) of substantially different pitch circle diameter, the gear wheel with the bigger pitch circle diameter (921) being meshed to one of said piston racks, the gear wheel (922) with the smaller pitch circle diameter being meshed to one of said racks of said rack-frame (220), the rotation of the crankshaft (9), by means of the connecting rod (6) and the wrist pin (60), causes the reciprocation of the rack-frame (220) along a stroke, the reciprocation of the rack-frame (220) causes the rotational oscillation of the gear shafts (91) and (92), the rotational oscillation of the gear shafts (91) and (92) causes the reciprocation along a substantially longer stroke of the piston (210) at opposite direction than the direction of the reciprocation of the rack-frame (220), while the displacement of the gear wheel casing (90) changes the compression ratio.

8. A reciprocating variable compression ratio engine according claim 7 wherein the ratio of the mass of the piston (210) to the mass of the rack-frame (220) together with mass of the wrist pin (60) and together with the reciprocating part of the mass of the connecting rod (6) is substantially equal to the ratio of the pitch circle diameter of the gear wheel (912) of the first gear shaft (91) to the pitch circle diameter of the gear wheel (911) of the first gear shaft (91).

* * * * *